US007854340B1

(12) United States Patent
Baker et al.

(10) Patent No.: US 7,854,340 B1
(45) Date of Patent: Dec. 21, 2010

(54) STACKABLE STORAGE CONTAINERS WITH CONNECTING LATCHES

(75) Inventors: Terry L. Baker, Boggstown, IN (US); Rebecca Baker, Boggstown, IN (US)

(73) Assignee: Greatbatch Medical S.A., Orvin (CH)

( * ) Notice: Subject to any disclaimer, the term of this patent is extended or adjusted under 35 U.S.C. 154(b) by 761 days.

(21) Appl. No.: 11/725,533

(22) Filed: Mar. 19, 2007

(51) Int. Cl.
*B65D 6/28* (2006.01)
*B65D 8/18* (2006.01)

(52) U.S. Cl. ..... 220/4.26; 220/676

(58) Field of Classification Search ..... 220/674, 220/693, 692, 682, 4.01, 676, 677, 675, 669, 220/660, 315, 200
See application file for complete search history.

(56) References Cited

U.S. PATENT DOCUMENTS

| | | | | | |
|---|---|---|---|---|---|
| 2,919,826 | A | * | 1/1960 | Richter | 220/1.5 |
| 3,044,656 | A | * | 7/1962 | Combs et al. | 220/4.28 |
| 3,316,460 | A | * | 4/1967 | Scoville | 361/796 |
| 3,401,814 | A | * | 9/1968 | Chiswell et al. | 220/4.33 |
| 4,002,261 | A | * | 1/1977 | Litchfield | 220/683 |
| 4,673,087 | A | * | 6/1987 | Webb | 206/600 |
| 4,728,504 | A | | 3/1988 | Nichols | 422/297 |
| 4,981,224 | A | | 1/1991 | Rushing | 211/126 |
| 5,161,709 | A | * | 11/1992 | Oestreich, Jr. | 220/6 |
| 5,259,523 | A | * | 11/1993 | Scherb | 220/4.26 |
| 5,384,103 | A | | 1/1995 | Miller | 422/310 |
| 5,415,846 | A | | 5/1995 | Berry, Jr. | 422/97 |
| 5,540,901 | A | | 7/1996 | Riley | 422/300 |
| 6,010,670 | A | * | 1/2000 | Berry, Jr. | 422/295 |
| 6,138,850 | A | | 10/2000 | Berry, III | 220/4.28 |
| 6,592,000 | B1 | | 7/2003 | Owens et al. | 220/324 |
| 6,783,004 | B1 | | 8/2004 | Rinner | 206/368 |
| 6,868,970 | B2 | | 3/2005 | Forsyth et al. | 206/725 |
| 6,874,634 | B2 | | 4/2005 | Riley | 206/439 |
| 6,896,149 | B1 | | 5/2005 | Berry, III | 220/4.28 |
| 6,991,108 | B1 | | 1/2006 | Rorato et al. | 206/503 |
| 7,021,485 | B1 | | 4/2006 | Baker et al. | 220/326 |
| 2006/0071002 | A1 | | 4/2006 | Hurst | 220/345.1 |
| 2006/0266666 | A1 | | 11/2006 | Bettenhausen et al. | 206/370 |

* cited by examiner

*Primary Examiner*—Anthony Stashick
*Assistant Examiner*—Robert J Hicks
(74) *Attorney, Agent, or Firm*—Michael F. Scalise

(57) ABSTRACT

A modular storage container for articles according to one embodiment of the present invention comprises a floor panel, a plurality of stackable side walls constructed and arranged to be connectable to the floor panel, a plurality of stackable end walls constructed and arranged to be connectable to the floor panel, and a plurality of stackable corner members constructed and arranged to be connectable adjacent one edge to a side wall and adjacent an opposite edge to an end wall, wherein each side wall and each end wall defining a wall end opening and each corner member having a mounting hole surrounded by a cylindrical boss, each cylindrical boss being constructed and arranged to fit within a corresponding wall end opening.

25 Claims, 43 Drawing Sheets

STACKABLE STORAGE CONTAINERS WITH CONNECTING LATCHES

BACKGROUND OF THE INVENTION

The present invention relates in general to device and instrument trays and cases that are stackable and constructed from a limited grouping of standardized component parts, i.e., having a modular construction. Included are novel pivot latches that are assembled to the tray ends and tray sides. A novel slide latch is also disclosed. More specifically, the tray portion of the present invention relates to the use of modular components that are shaped to interfit with other modular components, whether as part of a single tray or as part of a stack of trays. Regardless of the style of tray or case that is being configured, the same basic group of modular component parts is provided. In addition to the stack of a plurality of virtually identical trays, removal of a floor component from the second and higher trays converts the stack into a single tray of increased depth. The pivot latches are constructed and arranged to connect adjacent trays and to secure a closing lid.

As used herein, a "tray" includes, at a minimum, either individually or combined, a floor, two side panels, and two end panels. Optional corner members can be separate components or can be integrated into the side panels, the end panels, or the floor. When a closing lid is added to the tray, the combination becomes a "case". "Container" is used as a generic description of either a tray, a stack of trays, or a case.

Trays and cases for devices and instruments are most often associated with the storage of medical and/or dental devices and instruments that require sterilization and thereafter temporary storage. While this is the described context of the present disclosure, it is important to understand that the modular and stackable trays and cases, as described herein, can be used for the containment of virtually any type of device, instrument, or component.

Prior art trays and cases of the type used for medical and/or dental devices and instruments have been fabricated by the assembly of exchangeable individual component parts in order to create a modular design. Prior art trays and cases of the type described above, without a modular construction, have been constructed and arranged with forms, shapes, and features that enable two or more trays or cases to be stacked, one on top of the other. While a limited number of earlier trays and cases may be considered to have a modular construction and be stackable, the ability to be stacked is independent of the configuration that accounts for the modular construction. This results in only being able to stack finished trays or cases. The construction disclosed herein integrates into at least one of the individual component parts features that enable the trays to be stacked as well as to have a modular construction. This permits the tray floor to be retained when stacking finished trays or removed when creating a single tray of increased depth.

The versatility of the disclosed construction is one aspect that produces an improved tray and case design. Another feature of the disclosed structure is the design of unique corner members that provide one element of the modular construction as well as facilitate the stackable configuration. A second style of corner member is provided for the base or bottom tray, but it still includes a structure that allows for the stacking of another tray on top. Both styles of corner members include a unique rivet hole and boss design that adds to the overall strength and rigidity of each tray. Still further features of these disclosed cases and tray structures are the two styles of connecting pivot latches and the slide latches on the closing lid. As will be described herein, the unique design of the rivet holes and cooperating bosses on the back side of each corner member cooperating with larger rivet holes in the lower corners of the end walls and side walls contribute to the overall improved strength and rigidity of each fabricated tray. This added strength and rigidity is achieved by these design features for a single tray of single depth as well as for a single tray of increased depth.

BRIEF SUMMARY

A modular storage container for articles according to one embodiment of the present invention comprises a floor panel, a plurality of stackable side walls constructed and arranged to be connectable to the floor panel, a plurality of stackable end walls constructed and arranged to be connectable to the floor panel, and a plurality of stackable corner members constructed and arranged to be connectable adjacent one edge to a side wall and adjacent an opposite edge to an end wall, wherein each side wall and each end wall defining a wall end opening and each corner member having a mounting hole surrounded by a cylindrical boss, each cylindrical boss being constructed and arranged to fit within a corresponding wall end opening.

One object of the present disclosure is to describe an improved stackable tray construction using modular component parts.

DETAILED DESCRIPTION

Figure 1:
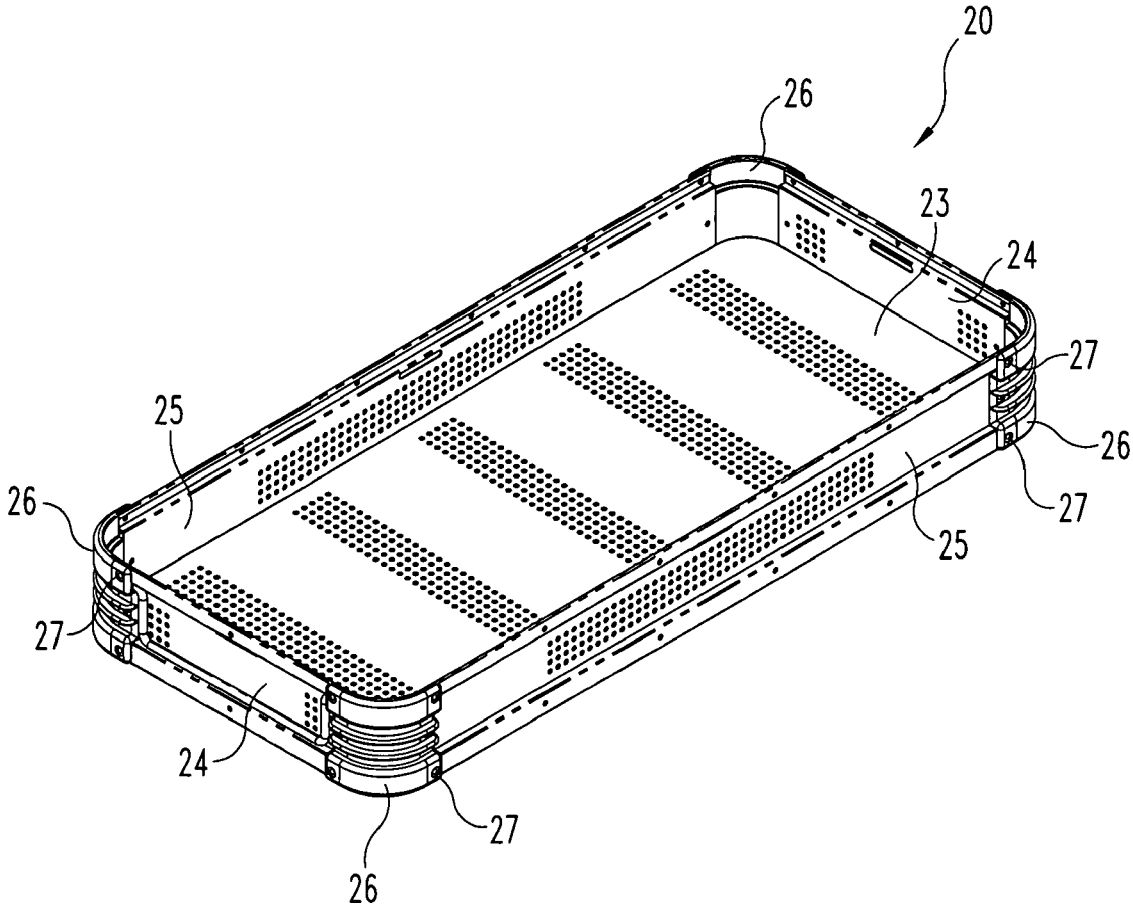
FIG. 1 is a perspective view of a single tray constructed of modular components according to a typical embodiment of the present invention.

For the purposes of promoting an understanding of the disclosure, reference will now be made to the embodiments illustrated in the drawings and specific language will be used to describe the same. It will nevertheless be understood that no limitation of the scope of the disclosure is thereby intended, such alterations and further modifications in the illustrated device and its use, and such further applications of the principles of the disclosure as illustrated therein being contemplated as would normally occur to one skilled in the art to which the disclosure relates.

Referring to FIG. 1, there is illustrated a single tray 20 that is constructed and arranged with a modular design and is configured for the stacking of other trays on top. The stacking of additional "trays" can be accomplished using completed trays, with floor panels, or can be accomplished using tray frames, without floor panels. Additional tray frames without floor panels are used in this stacked configuration if it is desired to create a single tray of increased depth, as is described herein. When a closing lid 21 is assembled onto tray 20, a single-depth case 22 is created. The four slide latches 21*a* are securely attached to lid 21 and each slide latch 21*a* includes a sliding tongue 21*b* that engages a cooperating slot in tray 20. The specific construction of slide latch 21*a* is described in our commonly owned, co-pending application Ser. No. 11/725,532, filed on even date herewith. This commonly owned, co-pending application is incorporated by reference herein in its entirety.

Figure 3:
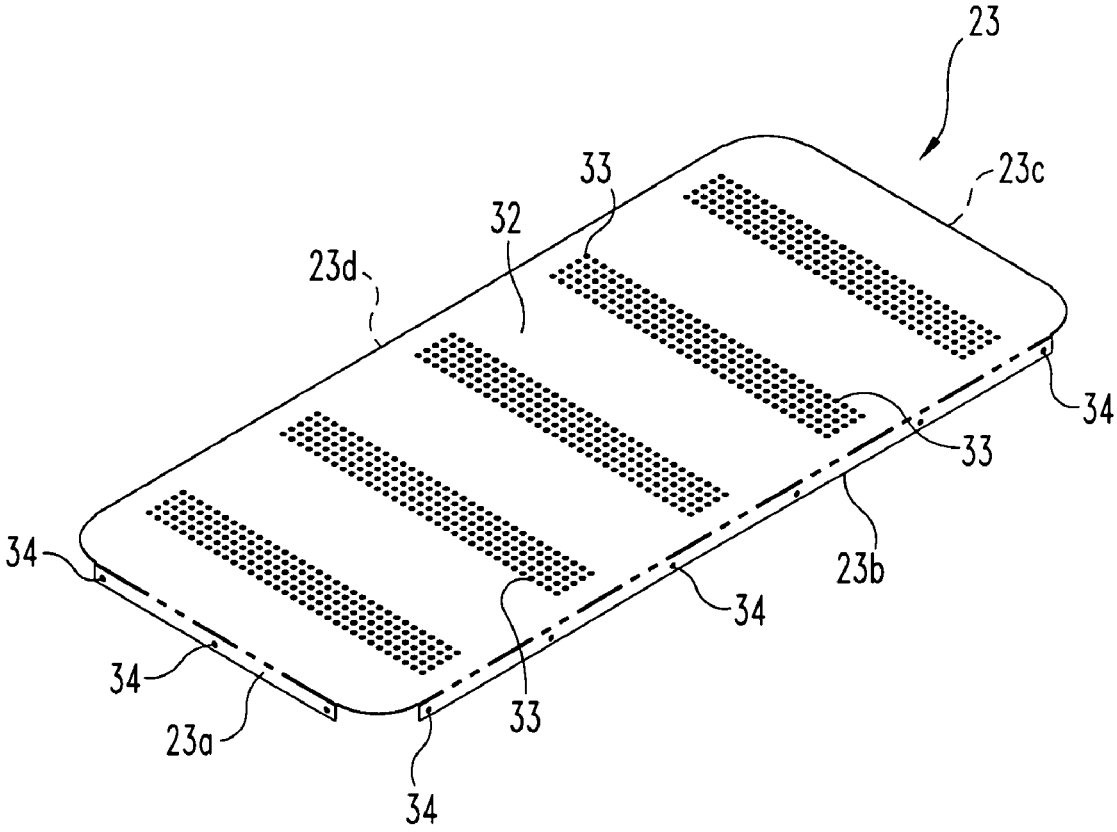
FIG. 3 is a perspective view of a floor panel comprising one modular component of the FIG. 1 tray.
Figure 4:
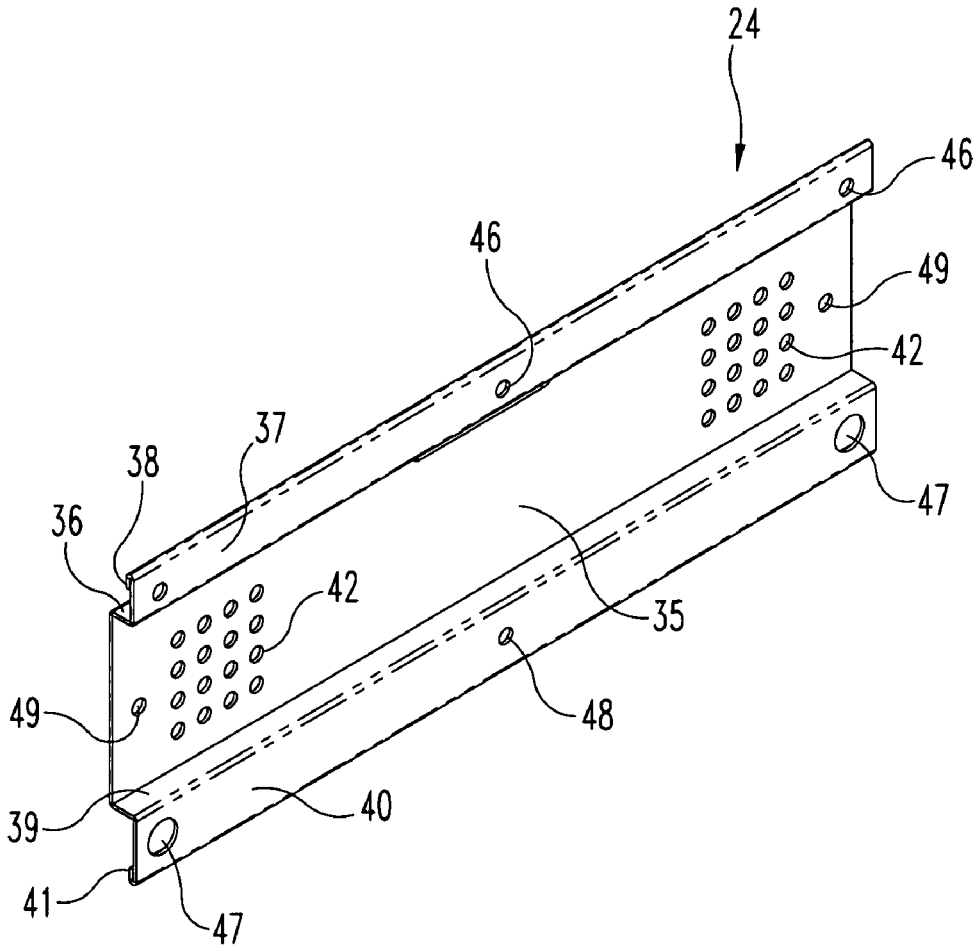
FIG. 4 is a perspective view of an end wall comprising one modular component of the FIG. 1 tray.
Figure 5:
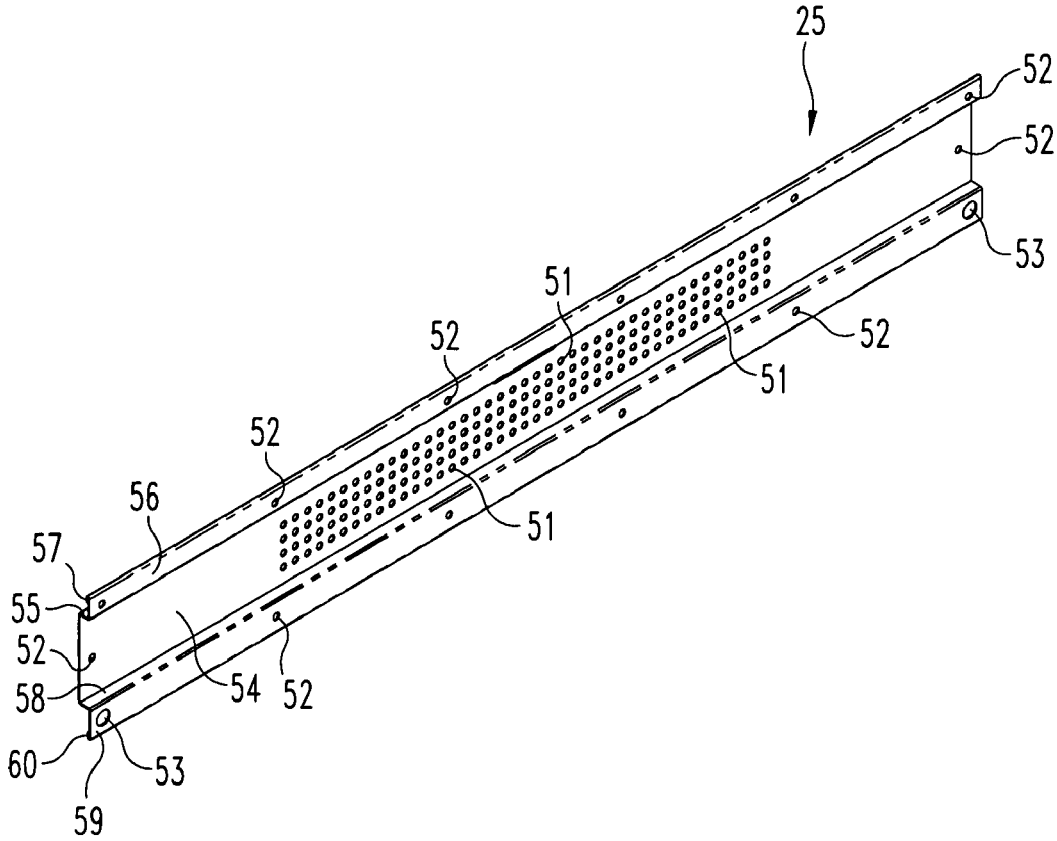
FIG. 5 is a perspective view of a side wall comprising one modular component of the FIG. 1 tray.

The modular construction of tray 20 includes, as component parts, a floor panel 23, end walls 24, side walls 25, and corner supports 26. These various component parts are secured together by rivets or similar fasteners though, as disclosed herein, rivets are preferred. The structural configuration and details of floor panel 23 are illustrated in FIG. 3. The structural configuration and details of end wall 24 are illustrated in FIG. 4. The structural configuration and details of side wall 25 are illustrated in FIG. 5. The structural configuration and details of corner support 26 are illustrated in FIGS. 6 and 7.

Figure 6:
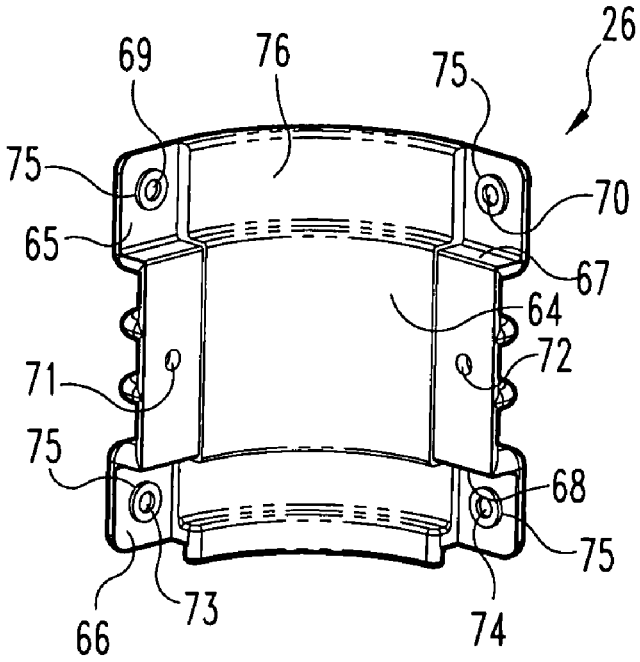
FIG. 6 is a perspective view of a corner support comprising one modular component of the FIG. 1 tray.
Figure 7:
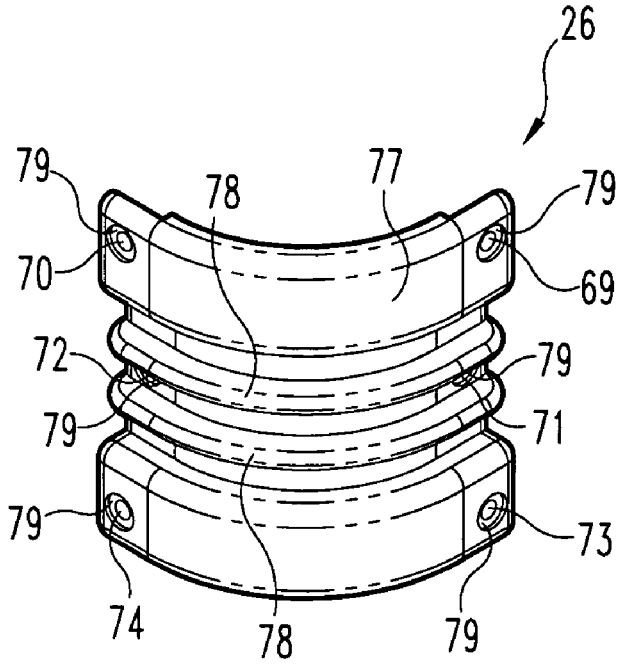
FIG. 7 is a perspective view of the FIG. 6 corner support.
Figure 10:
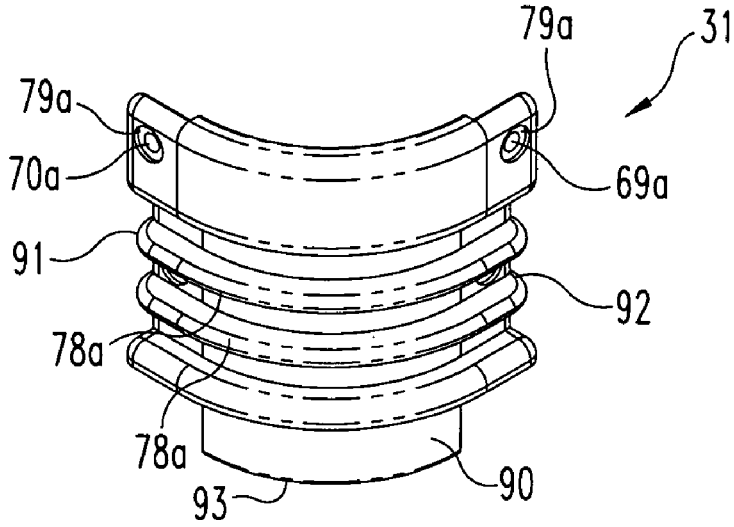
FIG. 10 is a perspective view of a stackable corner support according to the present disclosure.
Figure 11:
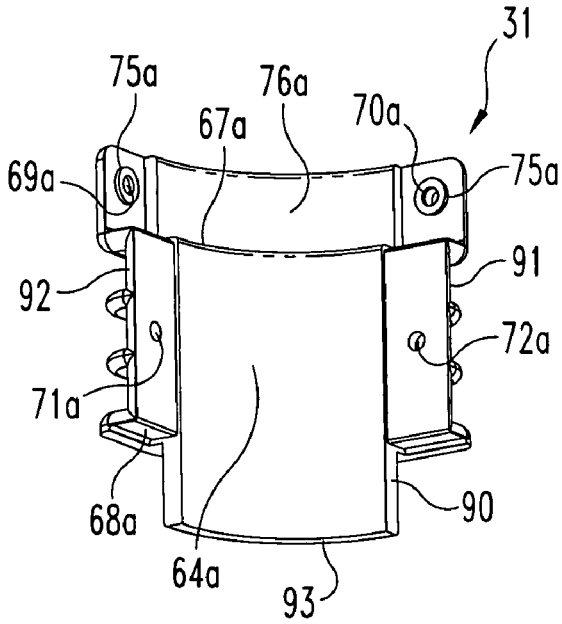
FIG. 11 is a perspective view of the FIG. 10 stackable corner support.

The corner support 26 of FIG. 6 is the style used for a single tray 20 and is the style used as part of the bottom or lowermost tray frame in a stack of tray frames when creating one tray with an increased depth. The upper tray frames in the referenced stack of trays for creating one tray of increased depth use a stackable style of corner support 31, as is illustrated in FIGS. 10 and 11. Stackable corner support 31 is constructed and arranged to stack onto another stackable corner support 31 as well as being constructed and arranged to stack onto corner support 26. Additionally, when stacking completed trays such that each tray includes its own floor panel, one corner support 26 is constructed and arranged to stack onto another corner support 26. The modular constructions disclosed herein enable the same and similar component parts to be used for stackable single trays as well as trays of increased depth. In order to help transport a stack of single trays and to transport a tray of single or increased depth, a pair of latch to constructions are illustrated in FIGS. 22-45.

Figure 8:
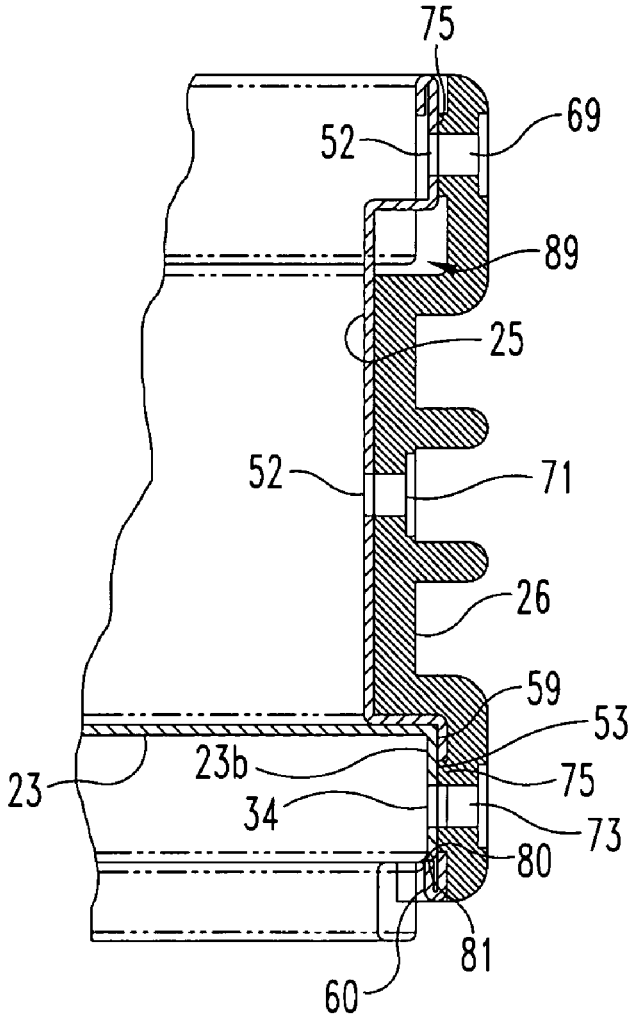
FIG. 8 is a partial, side elevational view, in full section, of the FIG. 1 tray.

The construction of tray 20 involves connecting each corner support 26 to one end of one end wall 24 and to one end of one side wall 25. The floor panel 23 includes a down-turned lip 23*a*-23*d* along each side and each down-turned lip fits up against a portion of a corresponding one of the two end walls 24 and of the two side walls 25. In the FIG. 3 drawing, only lips 23*a* and 23*b* are shown. Lip 23*c* is opposite to lip 23*a* and lip 23*d* is opposite to lip 23*b*. The corresponding wall portion (either an end wall 24 or a side wall 25) is fitted up against a portion of the corresponding corner support 26. A fastener, preferably a rivet 26, is inserted through these three components in order to secure the combination, as is illustrated in FIG. 8.

Referring now to FIG. 3, floor panel 23 has a substantially flat upper surface 32 with a plurality of apertures 33 for the passage of sterilant. Each down-turned lip 23*a*-23*d* is substantially flat and is constructed and arranged to be substantially perpendicular to upper surface 32. Each lip 23*a*-23*d* includes a series of rivet holes 34 that are used for securing the floor panel 23 to the end walls 24, to the side walls 25, and to the corner supports 26. The rounded form of each "corner" of upper surface 32 is compatible with the curved or rounded inner surface of each corner support 26.

Figure 16:
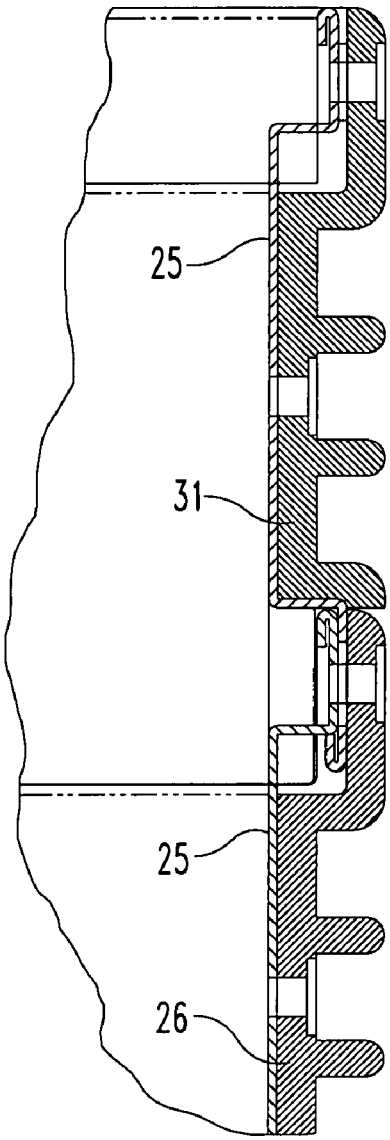
FIG. 16 is a partial, side elevational view, in full section, of the FIG. 14 stacked combination as assembled with the FIG. 15 stacked combination.

Referring now to FIG. 4, end wall 24 is constructed and arranged with seven formed sections 35-41, as defined and described herein. The center panel 35 is substantially flat and defines a plurality of sterilant apertures 42. Upper shelf 36 connects center panel 35 with offset section 37. Formed lip 38 is an extension of offset section 37. Lower shelf 39 connects center panel 35 with offset section 40. Formed lip 41 is an extension of offset section 40. Each section 35-41 is substantially flat and shelves 36 and 39 are substantially perpendicular to center panel 35. Offset sections 37 and 40 and formed lips 38 and 41 are all substantially parallel with center panel 35. Offset section 37 includes a series of three spaced-apart rivet holes 46. The lower offset section 40 includes a series of three spaced-apart rivet holes with the end holes 47 being larger than the center holes 48. The center panel 35 includes two rivet holes 49. The three end rivet holes (3 at each end) 46, 49, and 47, are in vertical alignment with each other. The two center holes 46 and 48 are also vertically aligned with each other. This particular construction, focusing specifically on the larger end holes 47, permits a boss portion of each cooperating corner support 26 to be inserted into those larger rivet holes as is illustrated in FIGS. 8 and 16.

Referring now to FIG. 5, side wall 25 is constructed and arranged in a manner that is virtually identical to end wall 24, except for the greater length of side wall 25 and except for the number and pattern of sterilant apertures 51 and rivet holes 52 (smaller) and 53 (larger). The top to bottom height of each side wall 25 is the same as the top to bottom height of each end wall 24. In terms of the construction of side wall 25, it includes a center panel 54, upper shelf 55, offset section 56, formed lip 57, lower shelf 58, offset section 59, and formed lip 60. The parallel and perpendicular relationships described for the seven sections 35-41 of end wall 24 remain the same for the seven sections 54-60 of each side wall 25.

Referring now to FIGS. 6 and 7, the structural details of corner support 26 are illustrated. Each corner support 26 includes a center section 64 and upper and lower offset portions 65 and 66, respectively. Upper shelf 67 connects center section 64 and offset portion 65. Lower shelf 68 connects center section 64 and offset portion 66. Each corner support 26 has a curved shape that generally extends ninety degrees (90°), as would be understood for connecting "corner" support. To reinforce this understanding of a ninety degree span, it should be noted that an axis centerline drawn through the center of rivet hole 69 intersects an axis centerline drawn through the center of rivet hole 70 at a right angle. This same relationship of the intersecting axis centerlines and the included ninety degree angle applies to the pair of axis centerlines through rivet holes 71 and 72 as well as those through rivet holes 73 and 74. Each of these three pairs of rivet holes have axis centerlines that intersect with an included angle of ninety degrees.

The upper rivet holes 69 and 70 and the lower rivet holes 73 and 74 are each defined by a concentric, raised cylindrical boss 75 formed on the inside surface 76 of the corner support 26. The outer surface 77 includes raised rib 78 to provide added strength and rigidity as well as a decorative appearance. The outer surface 77 defines a cylindrical recess 79 concentrically surrounding each rivet hole 69-74. These surrounding recesses allow the heads of the rivets 27 to be flush to recessed relative to the surrounding outer surface.

FIG. 8 illustrates the assembly and connection of a portion of a single tray 20 including the floor panel 23, the corner support 26, and either an end wall 24 or a side wall 25. Since the end wall 24 and side wall 25 are virtually identical to each other in overall configuration and form, as depicted in FIG. 8, this section view is representative of the construction and assembly regardless of whether selecting an end wall 24 or a side wall 25. For the sake of adding reference numbers, side wall 25 has been selected for the FIG. 8 illustration.

With continued reference to FIG. 8, it will be seen that lip 23*b* of floor panel 23 fits up against offset section 59 such that the lower edge 80 of lip 23*b* is adjacent the upper edge 81 of formed lip 60. The boss 75 of corner support 26 fits into the larger rivet hole 53 and lower rivet holes 73, 53, and 34 are aligned. Rivet holes 71 and 52 are also aligned as are rivet holes 69 and 52. This construction and assembly is repeated on the opposite edge of the corner support 26 and is repeated for each of the other three corner supports 26. From the FIG. 8 illustration, it will be seen that the raised surrounding boss 75 extends through the larger rivet hole and the free face or upper face of that raised boss 75 abuts up against the outer surface of lip 23*b*. When the rivet 27 is installed, a tight, rigid, and secure joint is created, aided in part by being able to compress all of the assembled components together and clamp those components tightly together by the heading of the ends of the rivet 27. The raised boss thus serves as something of an abutment and eliminates any voids or clearance spaces between the stack of component parts that might contribute to weakness, breaking, or fracture. A similar arrangement applies to the upper rivet location through holes 69 and 52, though in that particular location there is no lip 23*b*. Nevertheless, the raised boss 75 still abuts up against the surface of the side wall 25.

Figure 9:
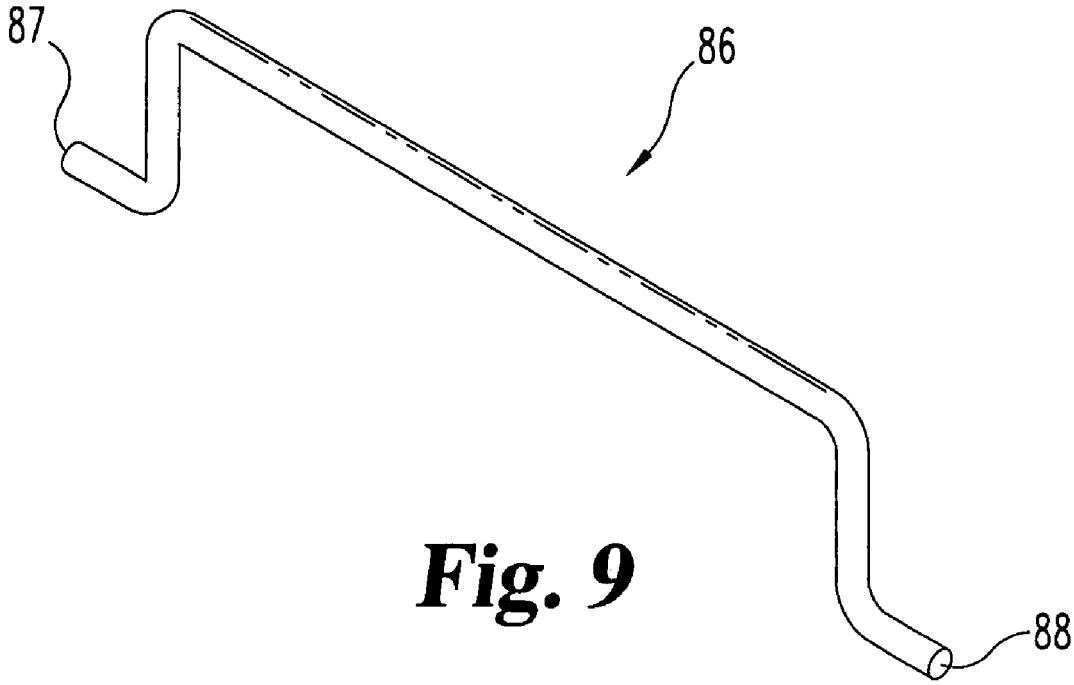
FIG. 9 is a perspective view of a handle comprising one part of the FIG. 1 tray.

With reference to FIG. 9, a handle 86 is illustrates and constitutes another component part of tray 20. Since it is possible to provide various handle styles for tray 20, handle 86 should be considered as one example of several possible choices or options. While the handling of tray 20 is believed to be facilitated by having some form of handle, even the handle should be considered as an optional choice.

The illustrated handle 86 includes opposite free ends 87 and 88 and these ends of handle 86 are constructed and arranged to freely rest on upper shelf 67 of corner support 26 and these free ends are effectively captured beneath upper shelf 55 of side wall 25. This clearance space is noted in FIG. 8.

Referring now to FIGS. 10 and 11, the details of the stackable corner support 31 are illustrated. Corner support 31 is only used if the second level to be added to a single tray is a tray frame such that the tray to be created is a single tray of increased depth. When completed, single trays 20, each having its own floor panel 23, are stacked together (see FIG. 21), then only corner supports 26 are used in the construction of each tray 20.

Each corner support 31 has a construction that is identical to roughly the upper two-thirds of corner support 26. The only differences between corner support 31 and corner support 26 are found in roughly the lower one-third of their respective construction. The lower offset portion 66, rivet holes 73 and 74, and the two corresponding cylindrical bosses 75, all of which are found as part of corner support 26, are replaced by the extended, curved tab 90 for corner support 31. As one way to help show or explain this identical construction, an "a" suffix is used for like reference numbers in FIGS. 10 and 11.

Tab 90 is centered between side edges 91 and 92 and extends a distance sufficient to fit against the upper offset portion 65 of the lower corner support 26 into and onto which the corner support 31 is stacked. This extended distance positions lower edge 93 up against upper shelf 67. This axial spacing and the relative dimensions result in rivet holes 69 and 70 of the lower corner support 26 being positioned at a location relative to the upper (stackable) corner support 31 such that the distance between rivet holes 69*a* and 69 is the same as the distance between rivet holes 69 and 73. This same dimensional relationship and identity holds true for the other side where the distance between the centers of rivet holes 70*a* and 70 is the same as the distance between the centers of rivet holes 70 and 74. This construction and relationship allows multiple tray frames to be stacked in a uniform and equally-spaced manner using the same standard, modular end walls 24 and side walls 25. Not only do corner supports 26 and 31 stack together, but each corner support 31 is stackable onto another corner support 31. This particular ability to be stackable one onto the other is enabled due to the fact that the upper two-thirds of corner support 31 is identical to the upper two-thirds of corner support 26 and their corresponding structures enable the stacked relationship. Lifting and transporting of the completed case, whether a case of increased depth or a stack of single trays, is facilitated by the use of latches as illustrated in FIGS. 22-45.

Figure 12:
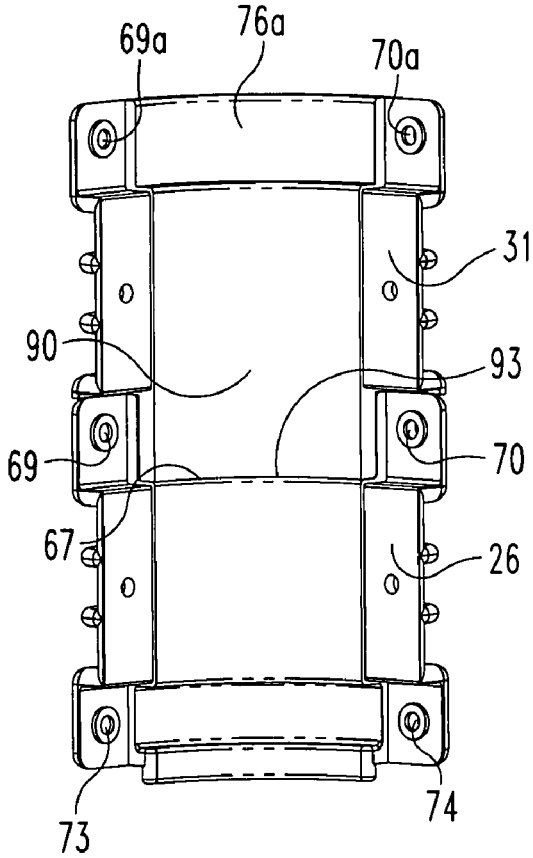
FIG. 12 is a perspective view of one FIG. 10 corner support as stacked on one FIG. 6 corner support.
Figure 13:
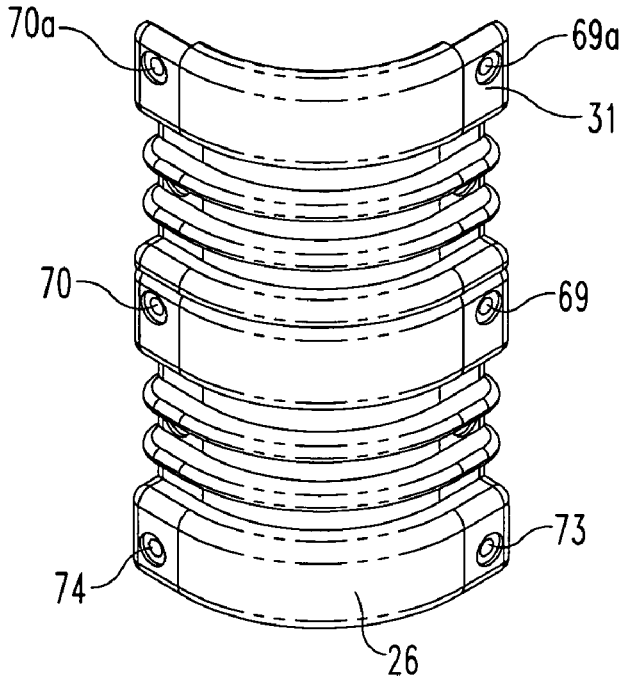
FIG. 13 is a perspective view of the FIG. 12 stacked assembly.
Figure 14:
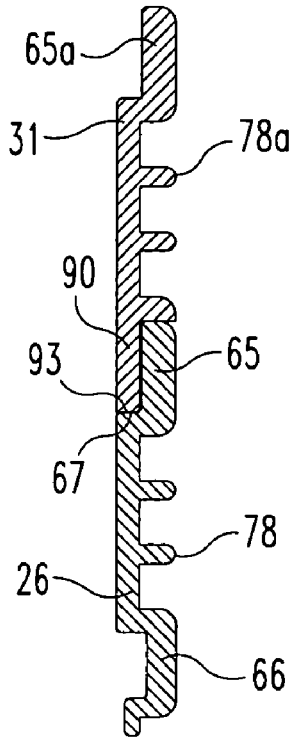
FIG. 14 is a side elevational view, in full section, of the FIG. 12 stacked assembly.

The stack of one corner support 31 into and onto corner support 26 is illustrated in FIGS. 12, 13, and 14. These three drawings depict the equal top-to-bottom spacing between adjacent pairs of rivet holes as previously described. FIGS. 12 and 14 also illustrate how tab 90 fits up against inside surface 76 and how lower edge 93 rests against upper shelf 67.

Figure 15:
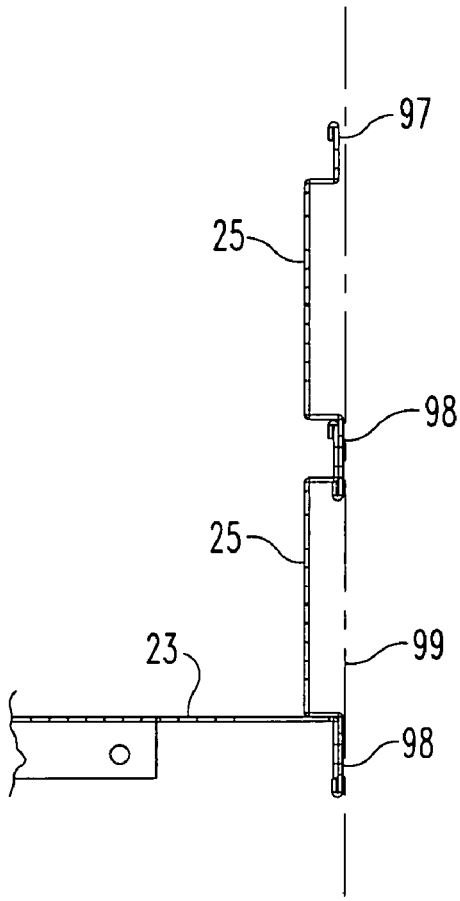
FIG. 15 is a side elevational view, in full section, of two side walls, as stacked together, according to the present disclosure.

Referring now to FIG. 15, the stack of two side walls 25 is illustrated, with a single floor panel 23. This particular stacked construction constitutes the construction of a double-deep tray and of note is the fact that the two stacked side walls 25 are identical. The slight offset between section 56 and section 59, in terms of where their outer surfaces 97 and 98 are positioned, is generally equal to the wall thickness of offset section 59. Since section 56 is set back this thickness amount, when the upper side wall 25 is stacked onto a lower side wall 25 in the manner illustrated, the outer surfaces 98 of the two side walls 25 are co-planar, as depicted by line 99.

Another dimensional relationship worth noting is that the distance from the free edge of lip 60 to the underside of shelf 58 is equal to the height of offset section 56. This is also the dimension of each lip 23*a*-23*d* of the floor panel 23, as is illustrated. It should be clear from the FIG. 15 illustration that any number of additional side walls 25 can be stacked, one on top of the other. It should also be clear from what has already been described and explained that the FIG. 15 illustration could also constitute a representation of how end walls 24 are stacked and assembled with a single floor panel 23. Since the side walls 25 and the end walls 24 are identical, except for the holes, hole patterns, and lengths, a side elevational view, in full section, such as that of FIG. 15, is the same whether using side walls 25 or end walls 24.

Referring now to FIG. 16, the FIG. 15 structure is combined with the FIG. 14 structure in order to illustrate the rivet connections at the juncture of the two side panels and at the uppermost location of a double-deep tray.

Referring now to FIGS. 17-21, additional examples of stacked trays and completed case assemblies (i.e., the addition of a closing lid 21) are illustrated. These assemblies are based upon and fully consistent with the individual modular parts that have been illustrated and the stacked assembly of those parts. While some of the prior illustrations focus on only a portion of a tray, or perhaps only a stacked assembly of two side walls 25, the uniformity and modular nature of the component parts and their common dimensions all contribute to the assemblies that are illustrated in FIGS. 17-21.

Figure 17:
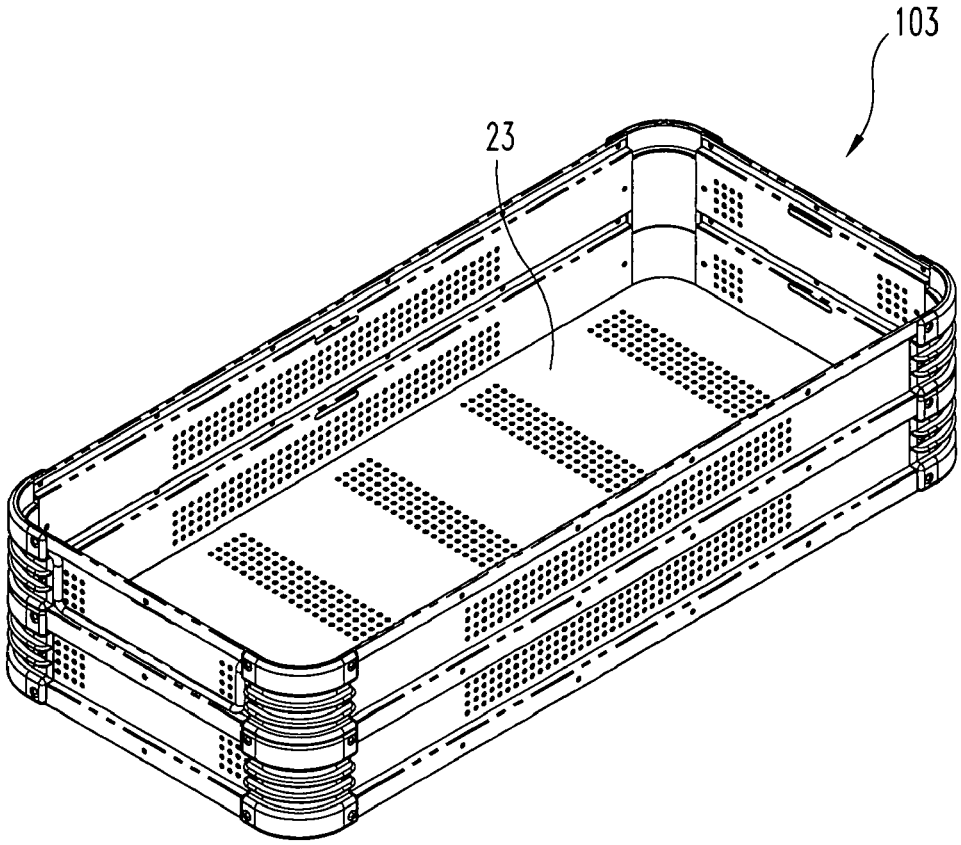
FIG. 17 is a perspective view of a double-deep tray according to the present disclosure.
Figure 18:
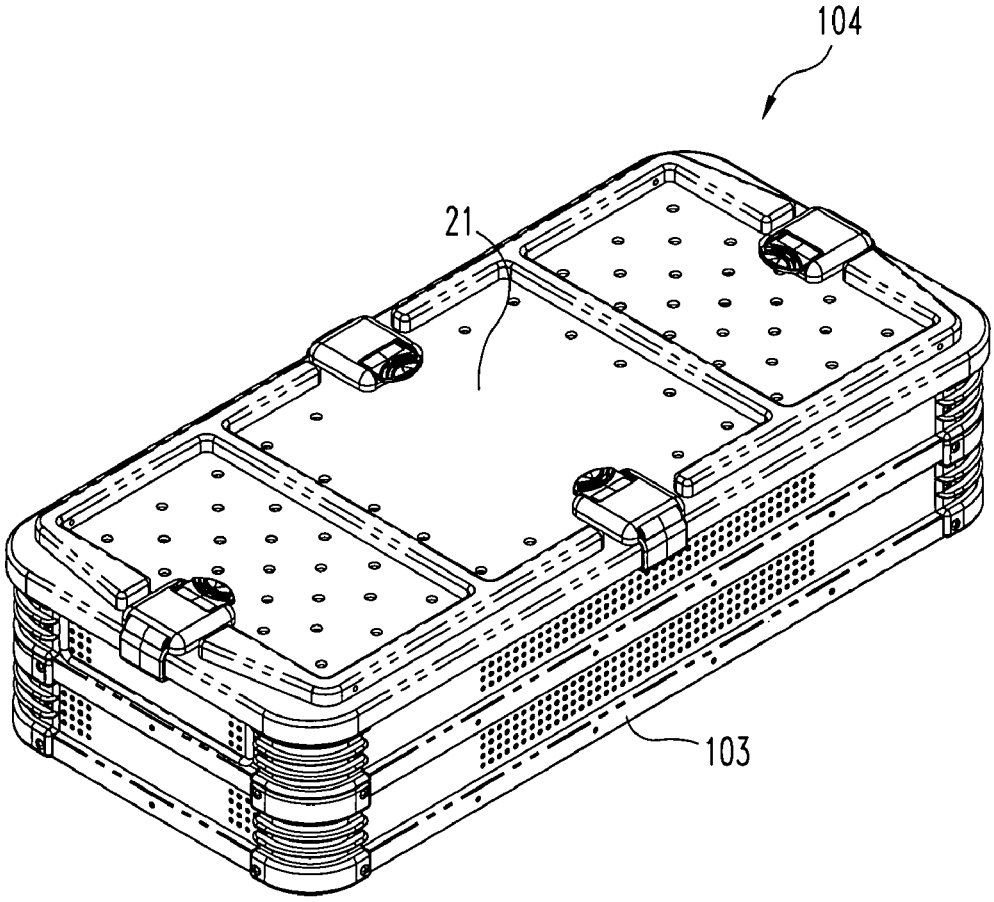
FIG. 18 is a perspective view of the FIG. 17 tray with a closing lid attached for creating a double-deep case.

FIG. 17 illustrates a double-deep tray 103 with two frames and a single floor panel 23, all of which are configured, constructed, and assembled based on the illustrations of FIGS. 1-16 and the structures disclosed in those drawing figures. The addition of a closing lid 21 to tray 103 creates a double-deep case 104, see FIG. 18.

Figure 19:
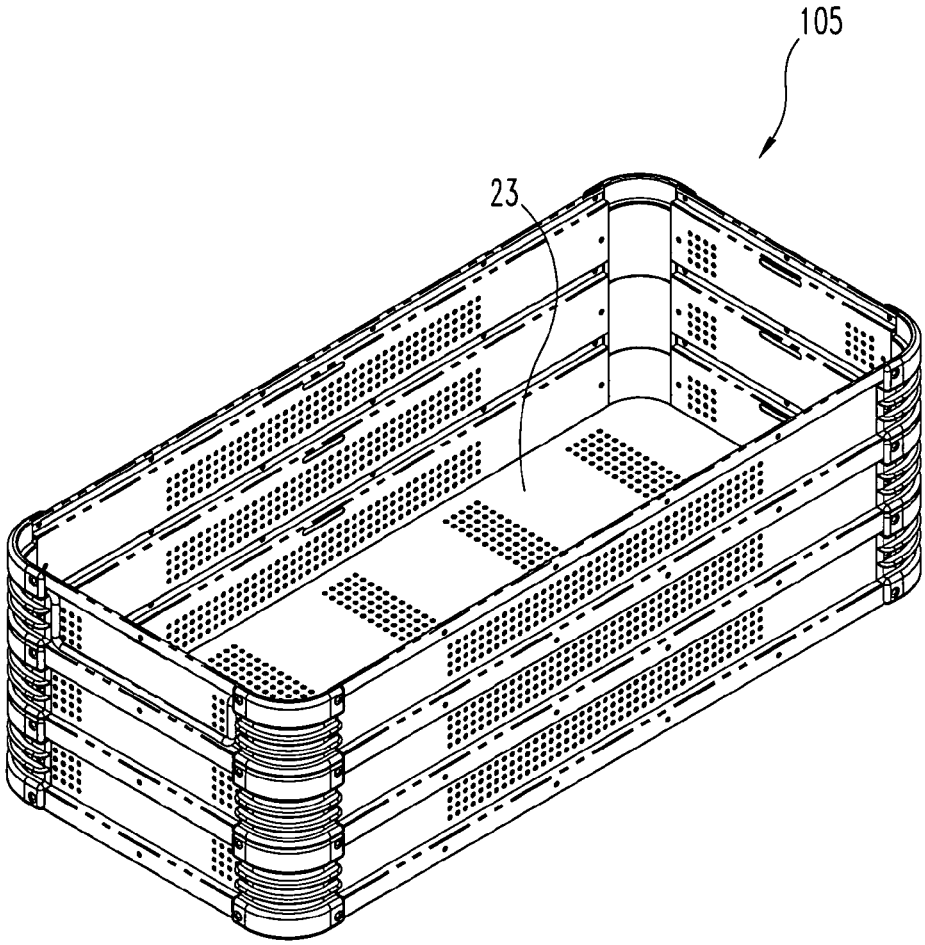
FIG. 19 is a perspective view of a triple-deep tray according to the present disclosure.

FIG. 19 illustrates a triple-deep tray 105 with three frames and a single floor panel 23, all of which are configured, constructed, and assembled based on the illustrations of FIGS. 1-16 and the structures disclosed in those drawing figures. The addition of a closing lid 21 to tray 105 creates a triple-deep case 106, see FIG. 20.

Figure 21:
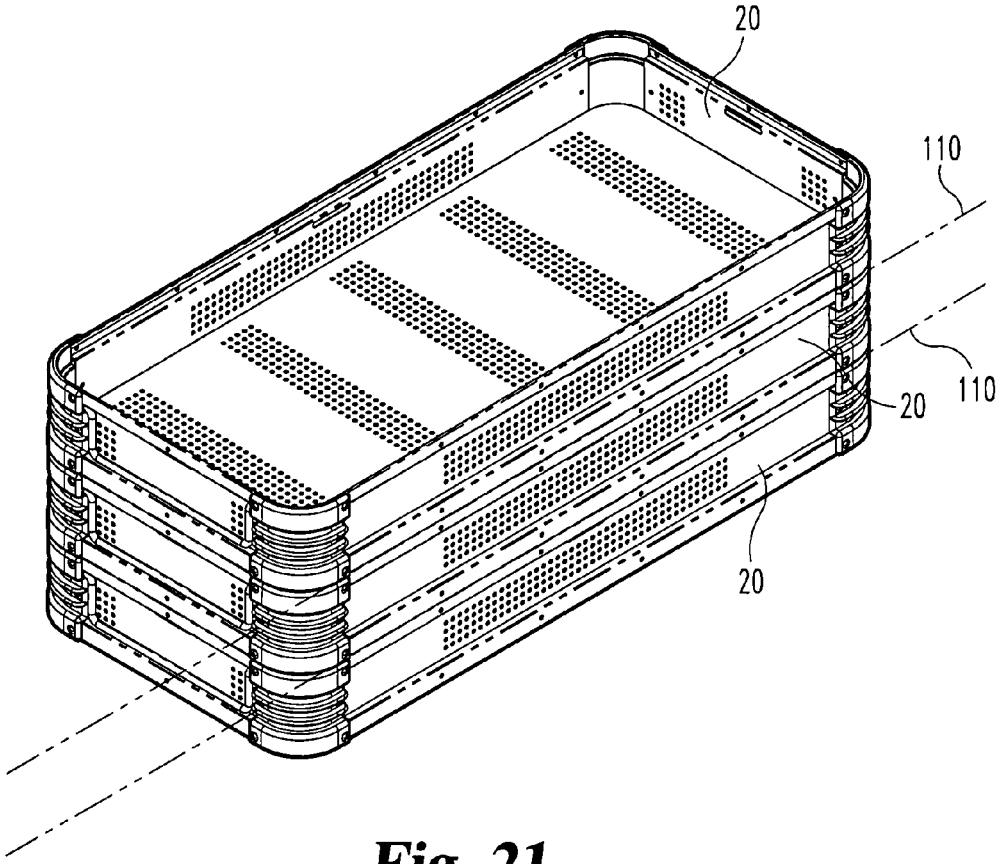
FIG. 21 is a perspective view of three single trays as stacked together, according to the present disclosure.

As previously noted during the description of corner supports 26 and 31, it is possible to stack completed single trays, each one having its own floor panel 23. This arrangement is illustrated in FIG. 21 and a careful study of this drawing figure will reveal the differences in the stack of three corner supports 26 as contrasted to the stack of one corner support 26 and two corner supports 31. A careful study will also reveal certain differences in the appearance between a stack of tray frames for a double or triple-deep single tray and the appearance when single trays with their own floor panel are being stacked.

Figure 20:
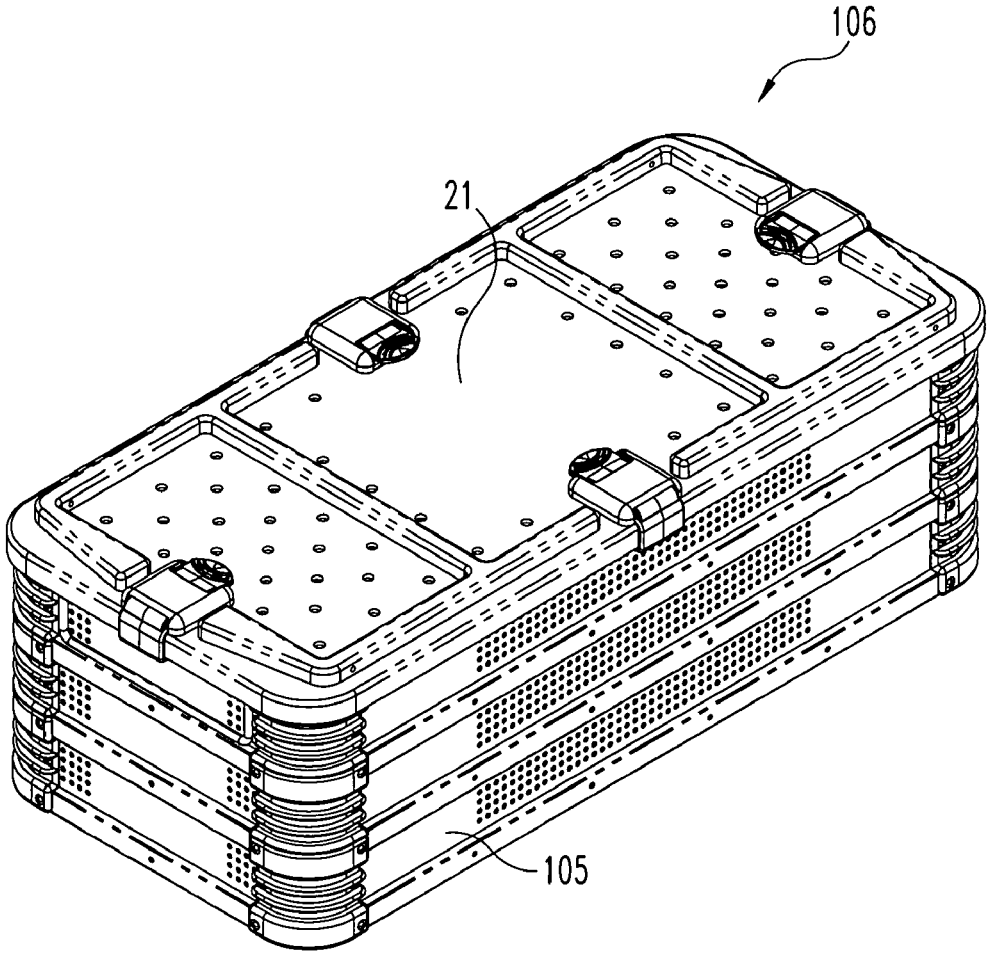
FIG. 20 is a perspective view of the FIG. 19 tray with a closing lid attached for creating a triple-deep case.

When two or more single trays are stacked, the "parting line" 110 reveals a pair of rivet holes, one on each side of line 110, as contrasted to only one rivet hole adjacent the parting line 110 location when a stackable corner support 31 is used. A similar configuration results along the sides and ends. A series of rivet holes are seen along the parting line 110, both above and below the line. This should be contrasted to what is illustrated in FIGS. 19 and 20 where only a single series of rivet holes is show along what would be considered the referenced "parting line" as between adjacent tray frames.

The explanation as to having either two series of rivet holes adjacent the parting line or only one series should be obvious based upon the descriptions that have been provided. When the second (upper) tray is assembled with its own floor panel 23, the space between the lower lip 60 and shelf 58, for example when considering side wall 25, is used for the floor panel lip and the two are riveted together. The rivet holes in the upper offset section 56 are not used. This explains why in the FIG. 21 illustration the rivet holes immediately above each parting line 110 have received rivets for their respective tray floor panel assembly. However, the rivet holes immediately below the parting line 110 remain open without any installed rivets.

Figure 22:
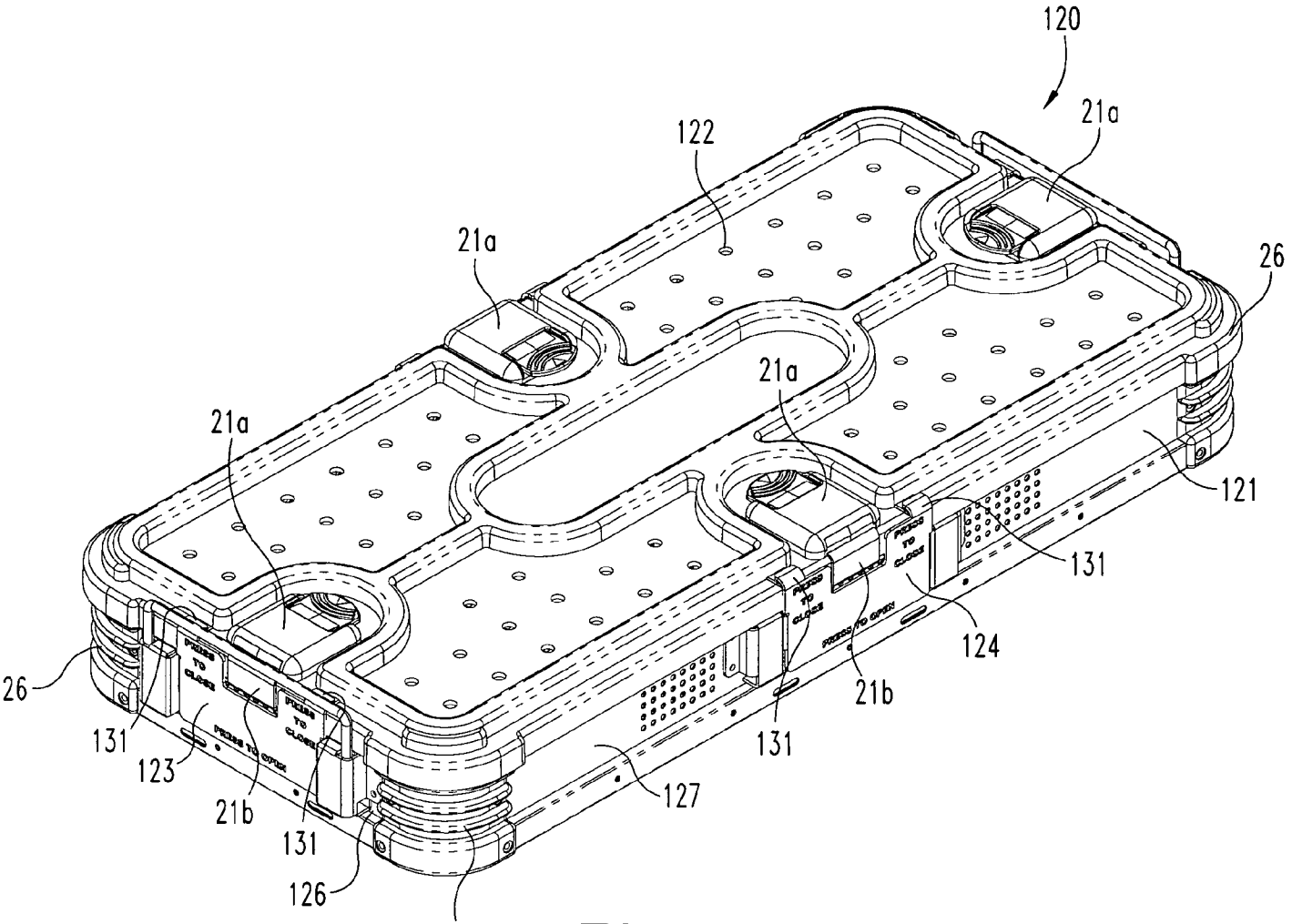
FIG. 22 is a perspective view of a completed case including end and side pivot latches and slide latches.

Referring to FIG. 22, there is illustrated a single-depth case 120 including a tray 121, closing lid 122, a pair of end pivot latches 123, and a pair of side pivot latches 124. Due to the perspective orientation of FIG. 22, only one end pivot latch 123 is fully illustrated and only one side pivot latch 124 is fully illustrated. The second end pivot latch 123 is at the opposite end of case 120 and the other side pivot latch 124 is on the opposite side of case 120.

The closing lid 122 includes four slide latches 21*a*, similar in form, fit, and function, to those used on closing lid 21. The tray 121 includes a floor panel 23, see FIG. 3, two end walls 126, two side walls 127, and corner supports 26. An end pivot latch 123 is securely attached to each end wall 126 with suitable fasteners, preferably rivets. A side pivot latch 124 is securely attached to each side wall 127 with suitable fasteners, preferably rivets. Due to a slightly different hole pattern and due to the addition of slots, end wall 126 is not identical to end wall 24. Similarly, due to a slightly different hole pattern and due to the addition of slots, side wall 127 is not identical to side wall 25. The floor panel 23 and the corner supports 26 of case 120 are identical to those used as part of case 22 of FIG. 2. While the end pivot latch 123 is similar to the side pivot latch 124, one difference is in the construction of some of the individual latch components of end pivot latch 123 so as to be able to incorporate an extendable gripping member (handle).

Figure 2:
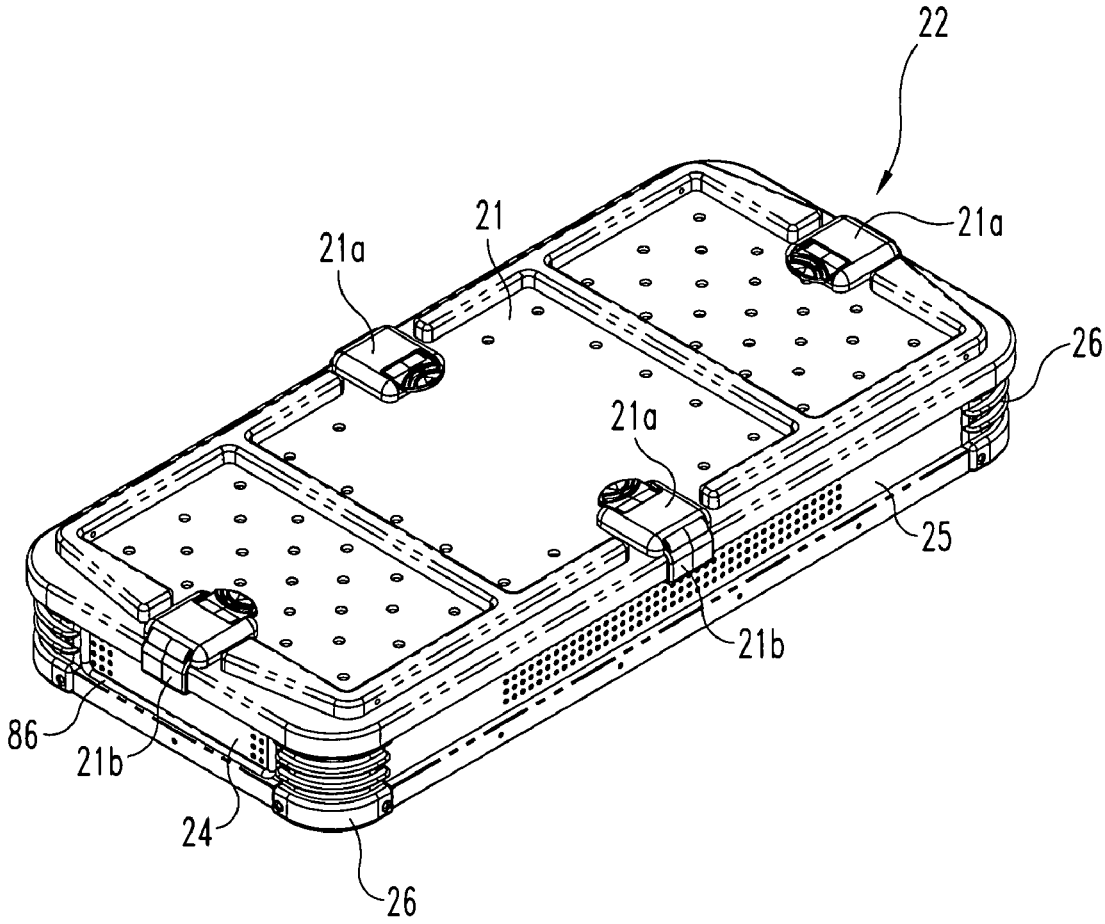
FIG. 2 is a perspective view of the FIG. 1 tray with a closing lid attached for creating a case.

Each slide latch 21*a* is constructed and arranged and used in the same manner illustrated in FIG. 2. The sliding tongue 21*b* of each slide latch 21*a* is movable for engagement with and disengagement from a cooperating slot formed in each end wall and each side wall. The engagement of each tongue 21*b* with the corresponding slot secures the lid 122 to the tray 121 for case 120. Although lid 122 has a different style compared to lid 21, the respective lids and slide latches function in a virtually identical manner. As disclosed herein, the lid securing function can be accomplished by pivot latches 123 and 124, with or without the use of the slide latches 21*a*.

Figure 23:
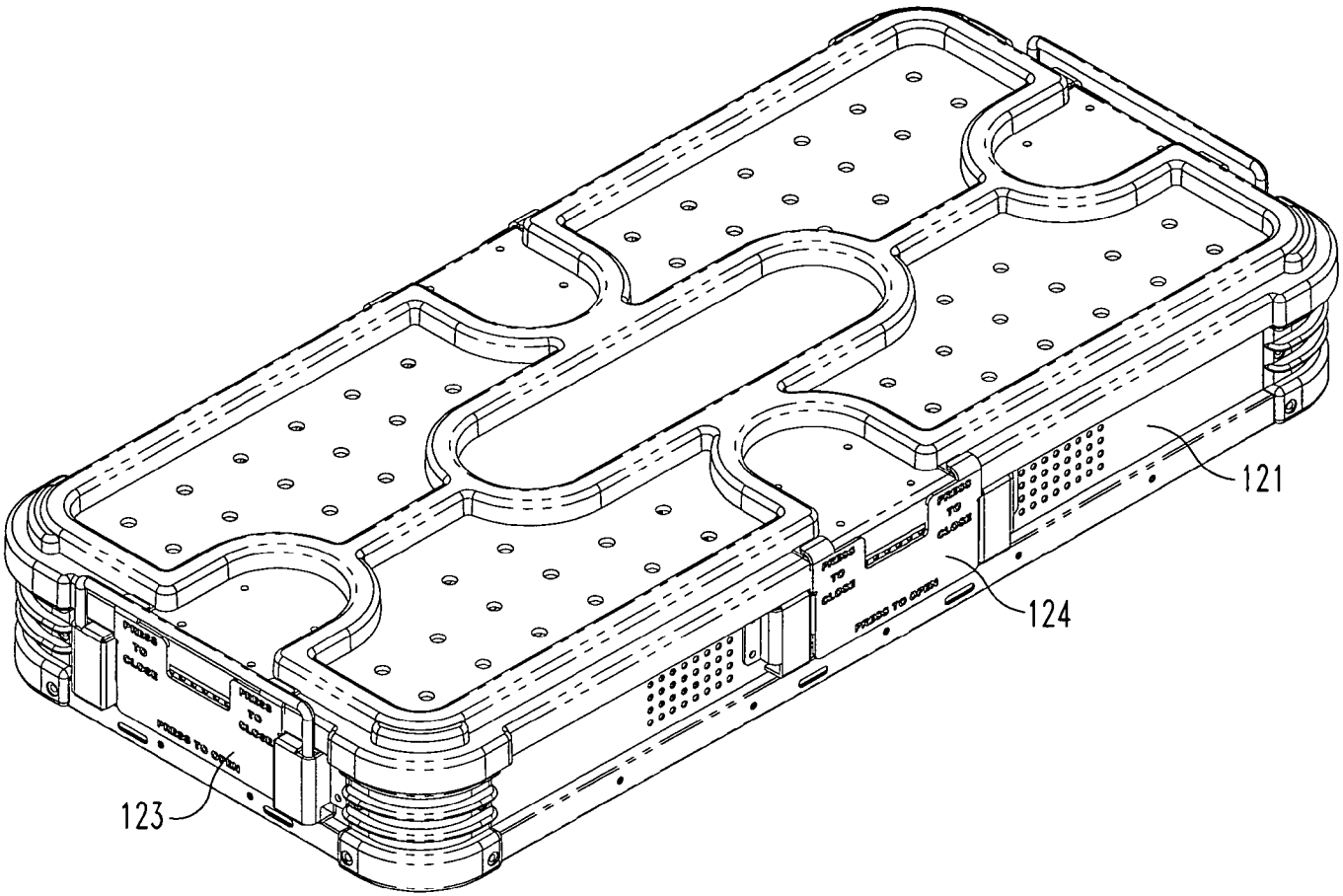
FIG. 23 is a perspective view of the FIG. 22 case illustrated without the addition of the FIG. 22 slide latches.

Referring now to FIG. 23, and with continued reference to FIG. 22, case 120 is illustrated without the four slide latches 21*a*. The FIG. 23 illustration depicts that the end pivot latches 123 and the side pivot latches 124 are sufficient to secure a closing lid onto the tray 121, without using any slide latches 21*a*. As will be explained and described in greater detail hereinafter, each pivot latch 123 and 124 includes a pair of spaced-apart connecting tabs 131. These connecting tabs are constructed and arranged to overlap an outer peripheral edge portion of the closing lid 122 in order to pull down on the lid in the direction of the tray 121 for the proper and secure closing of case 120. This action of pulling down on the lid by means of these connecting tabs 131 is accomplished by a pivoting action of a pivot plate which is included as part of the construction of each pivot latch 123 and 124.

Referring now to FIGS. 24-28, the stack of two single trays 121 is illustrated. While the addition of a closing lid 122 would complete this tray assembly, converting it into a "case", the lid is omitted from these drawings. If the lid is added, this "case" would be a double-tray case that includes two stacked-together single trays 121 and one closing lid 122. The closing lid 122 is omitted since these drawings focus on the use and construction of the two end pivot latches and of the two side pivot latches. Each single tray 121 includes two end pivot latches 123, one at each end, and two side pivot latches 124, one along each side.

As mentioned earlier, each end wall 126 includes a pair of cooperating slots 132. Each slot 132 is constructed and arranged to receive a connecting tab 131 of a latch 123 that is attached to the immediately lower (adjacent) tray 121 in the stack of trays. A similar arrangement exists on each side. Each side wall 127 includes a pair of cooperating slots 133. Each slot 133 is constructed and arranged to receive a connecting tab 131 of a latch 124 that is attached to a lower tray 121 in the stack of trays. This interfit of the latch connecting tabs 131 inserting into the slots 132, 133 of the adjacent, upper tray 121 is illustrated in FIGS. 24-28. The connecting tabs 131 of the uppermost tray 121 in the stack of trays, regardless of the number of stacked trays, are used for securing the closing lid 122 for making the stack of trays a case. The connecting tabs of all other trays, excluding the uppermost tray in the stack, are used for connecting adjacent trays together such that the entire stack of trays becomes a single unit that can be lifted, moved, and transported as a single unit.

Figure 24:
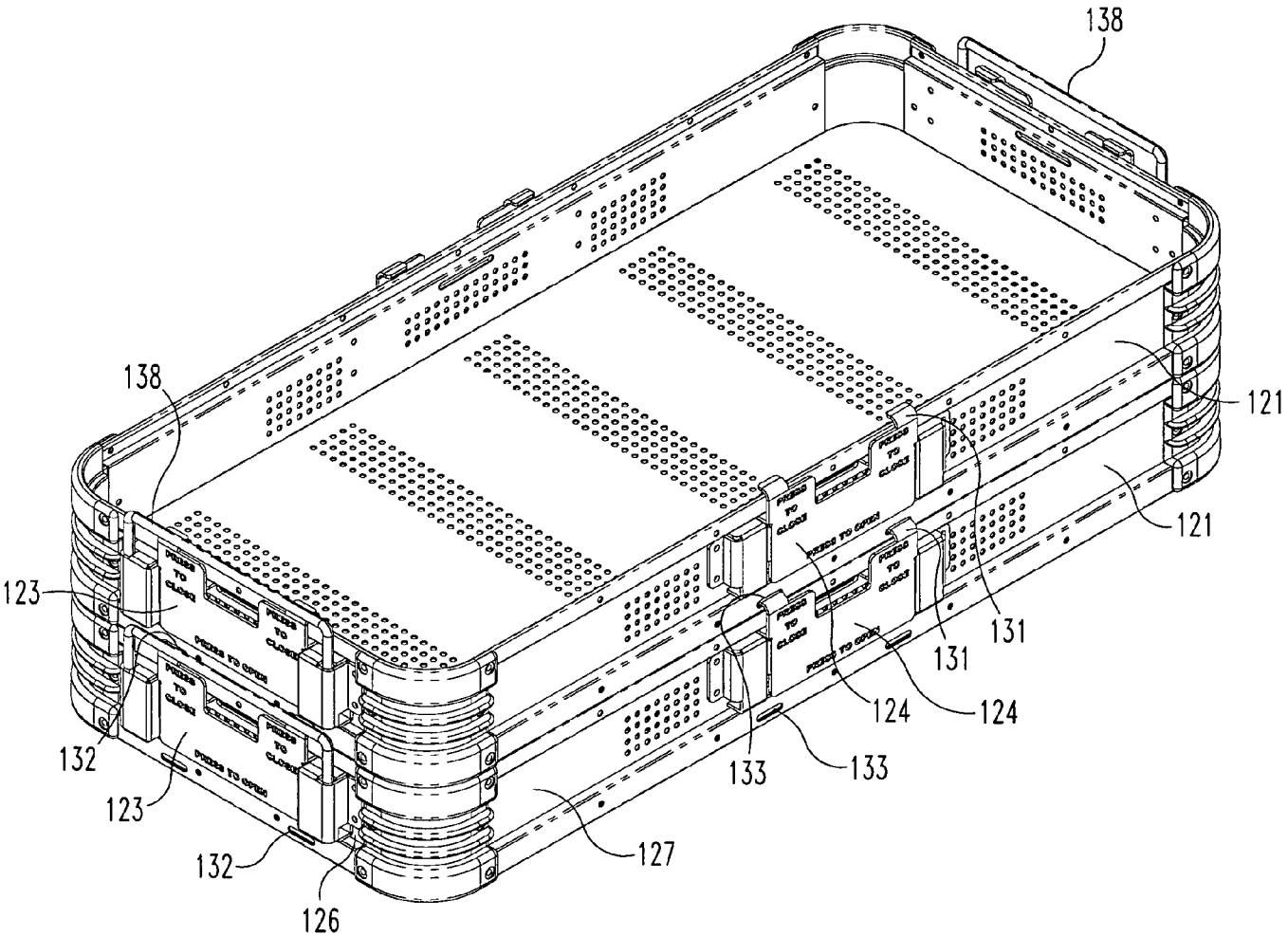
FIG. 24 is a perspective view of two single trays stacked together including end and side pivot latches.

FIG. 24 illustrates all of the latches 123 and 124 in what is best described as either a closed condition for those latches of the upper tray of the two trays that are illustrated, or a connected condition for those latches of the lower tray 121 of the two that are illustrated. The reference to "closed" refers to the position of the connecting tabs 131 of the upper tray 121 in securing a closing lid for "closing" the stacked trays into a case. The reference to "connected" refers to the position of the connecting tabs 131 of the lower tray as inserted into the slots 132 and 133 of the upper tray 121 so as to secure the stack of trays into a unitized assembly. As noted, the interfit of tabs 131 into slots 132 and 133 allows the stacked trays to be moved, lifted, handled, transported, etc. as a single unit.

Figure 25:
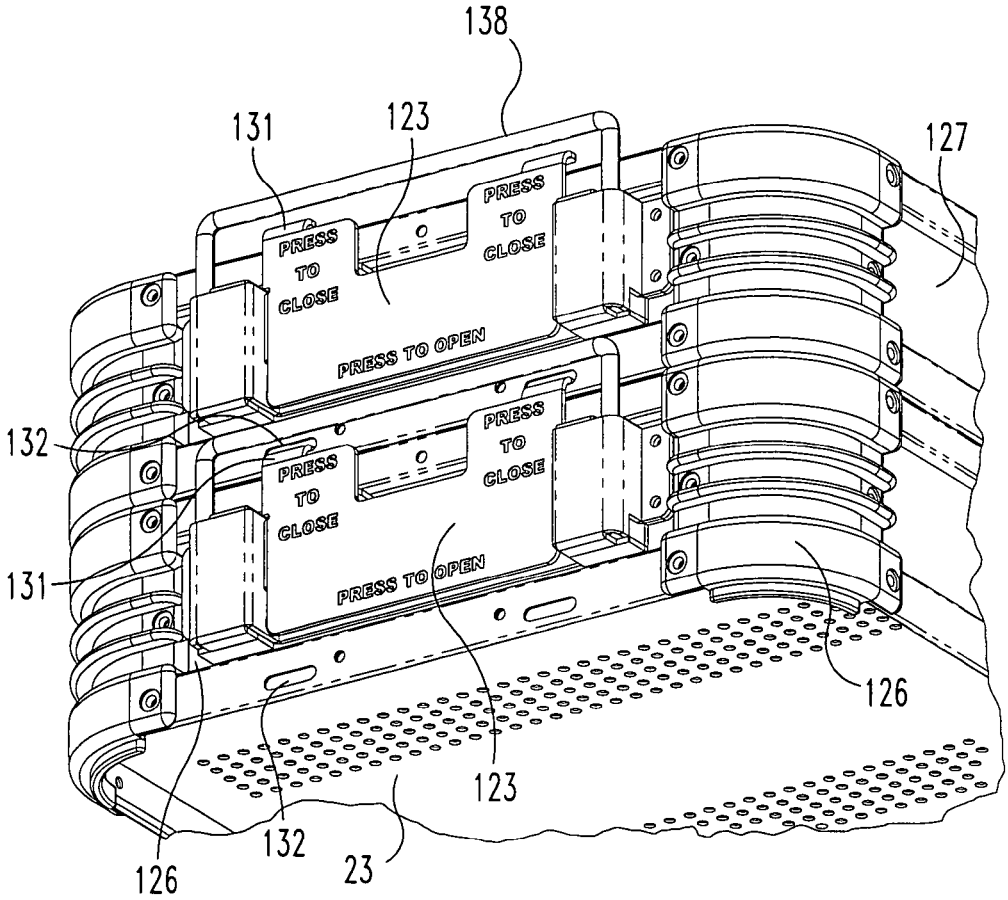
FIG. 25 is a partial, perspective view of one end of the FIG. 24 stack of single trays with the end pivot latches in a closed condition.
Figure 26:
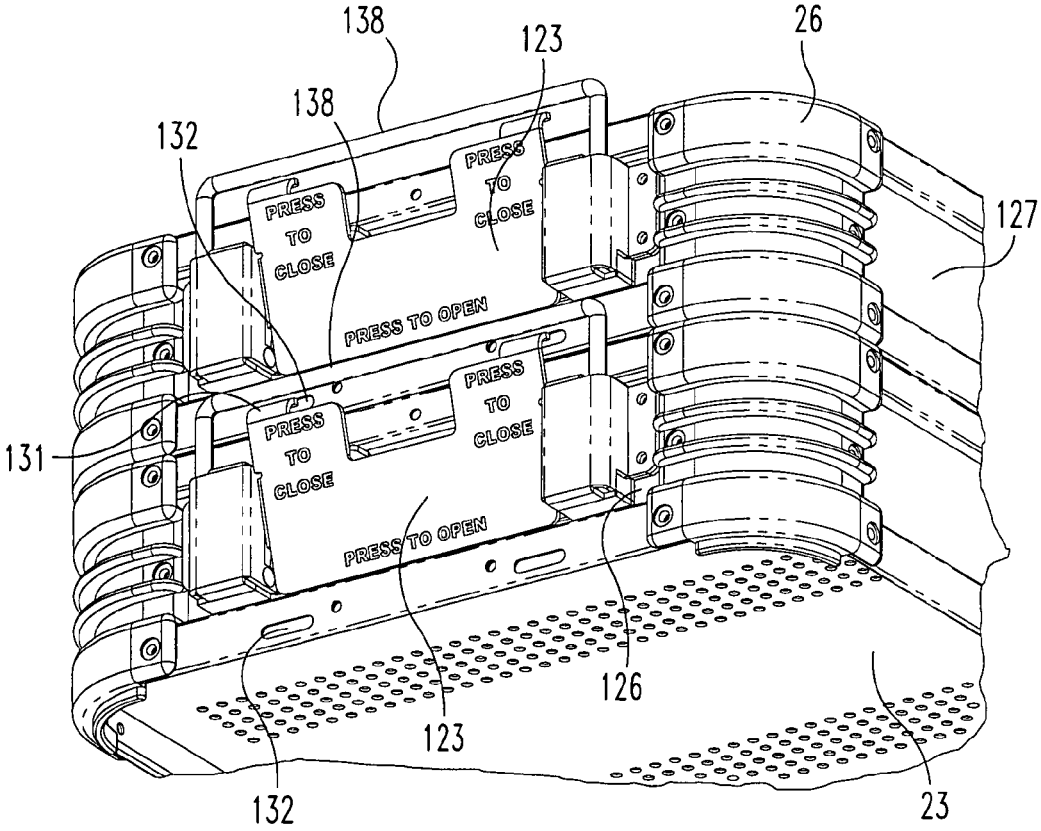
FIG. 26 is a partial, perspective view of the FIG. 25 arrangement with the end pivot latches in an open condition.

Referring to FIG. 25, the end pivot latches 123 are illustrated in the closed condition or position according to FIG. 24. In FIG. 26 these end pivot latches 123 have been pivoted to an open condition in the case of the upper tray 121 and to an unlatched or disconnected condition in the case of the lower tray 121. A pivoting action causes the connecting tabs 131 of the upper tray latches 123 to pivot away from the tray end wall 126. The pivoting movement is sufficient to move the tabs such that there is no overlap of the outer peripheral edge of the lid 122 by those tabs 131 of latches 123 of the upper-most tray. As for the pivot latches 123 of the lower tray 121, the pivoting movement of the connecting tabs 131 is sufficient to move those tabs out of the cooperating slots 132. This eliminates the tab and slot interfit and results in disconnecting the stacked single trays from one another.

Figure 27:
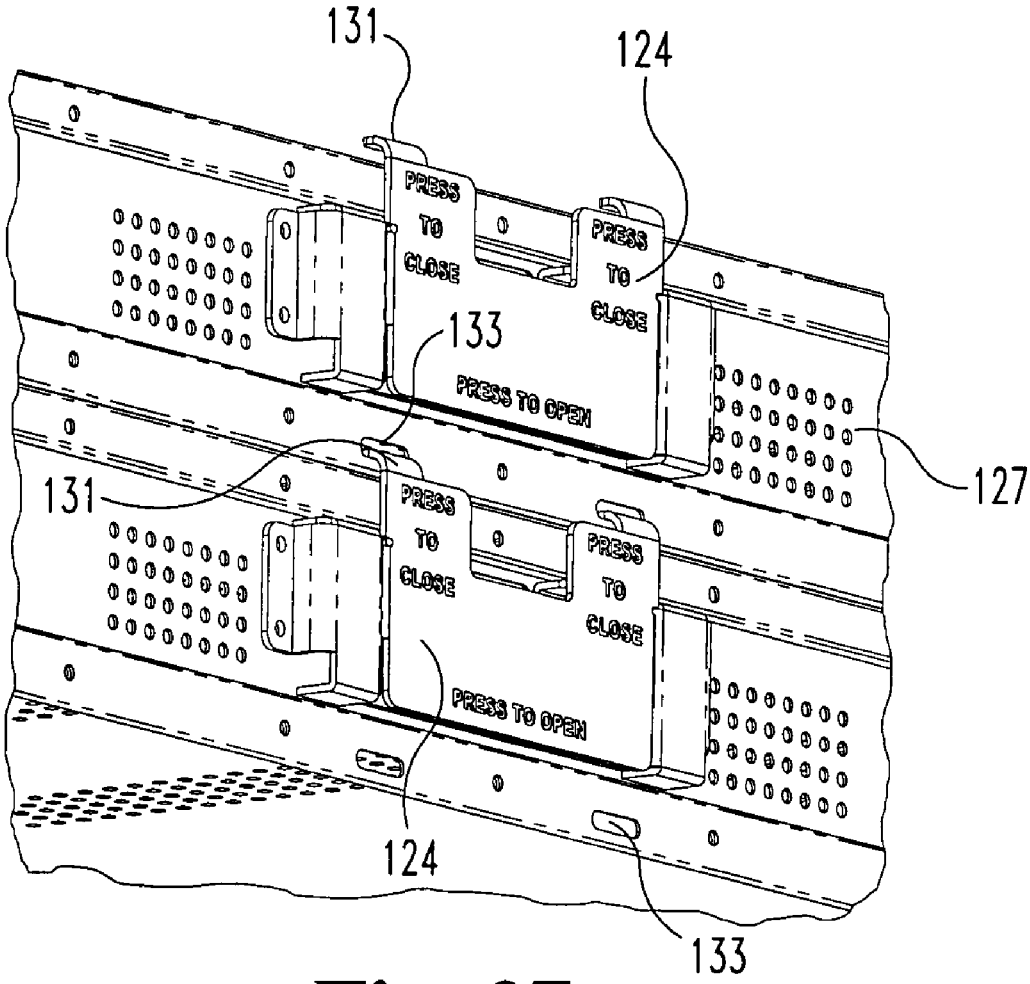
FIG. 27 is a partial, perspective view of the FIG. 24 side pivot latches in a closed condition.
Figure 28:
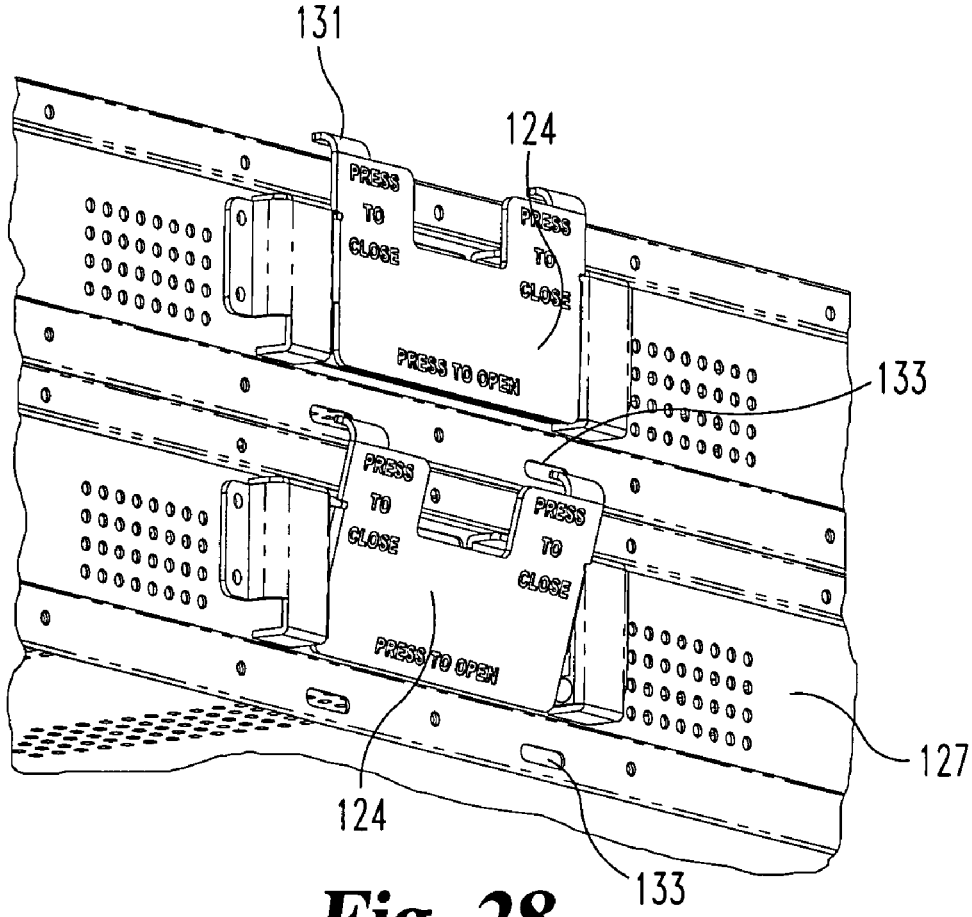
FIG. 28 is a partial, perspective view of the FIG. 27 construction with the side pivot latches in an open condition.

FIGS. 27 and 28 illustrate these same closed and open configurations for the side pivot latches 124 of the upper tray 121. Similarly, these two figures illustrate the connected and disconnected conditions for the side pivot latches 124 of the lower tray 121. FIG. 27 illustrates the closed and connected condition of the pivot latches. FIG. 28 illustrates the open and disconnected condition of the pivot latches. This style of tab 131 to slot 132 and 133 interfit for both the end walls 126 and side walls 127 occurs for every adjacent pair of trays, except the connecting tabs 131 of the uppermost tray 121 that are used to secure the closing lid 122 in position. The end pivot latches 123 each include a lifting handle which is described herein as a "gripping member" 138. In terms of terminology, the latch construction described as the "end pivot latch" provides a dual function in terms of both functioning as a latch for securing the closing lid or inter-connecting into an adjacent tray, but also provides a handle construction for ease in lifting either an individual tray or case or a stack of trays into a unitized case. The end location for each pivot latch 123, including its handle construction, represents the preferred location in terms of overall balance and ergonomics. As used herein, "handle" includes not only the gripping member that is grasped by the hand of a user, but it also includes the cooperating support structure that connects that gripping member to some other structure. As used herein, "end pivot latch" 123 is this combined structure and it includes a "gripping member" 138 that is received by portions of the latch. This gripping member is movable between retracted and extended conditions.

Figure 29:
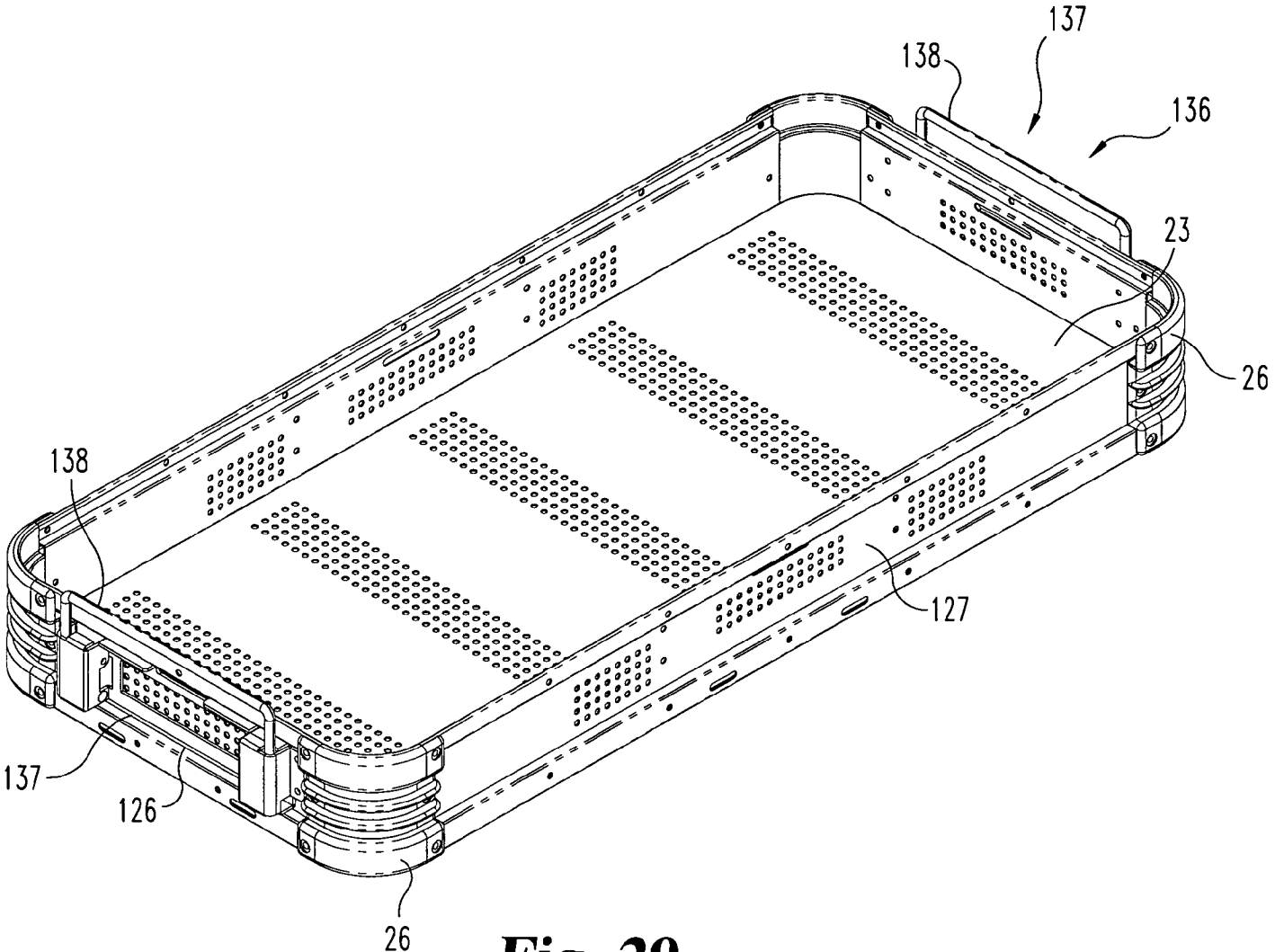
FIG. 29 is a perspective view of an alternative tray construction using end pivot latch components for a lifting handle illustrated in a retracted position.
Figure 30:
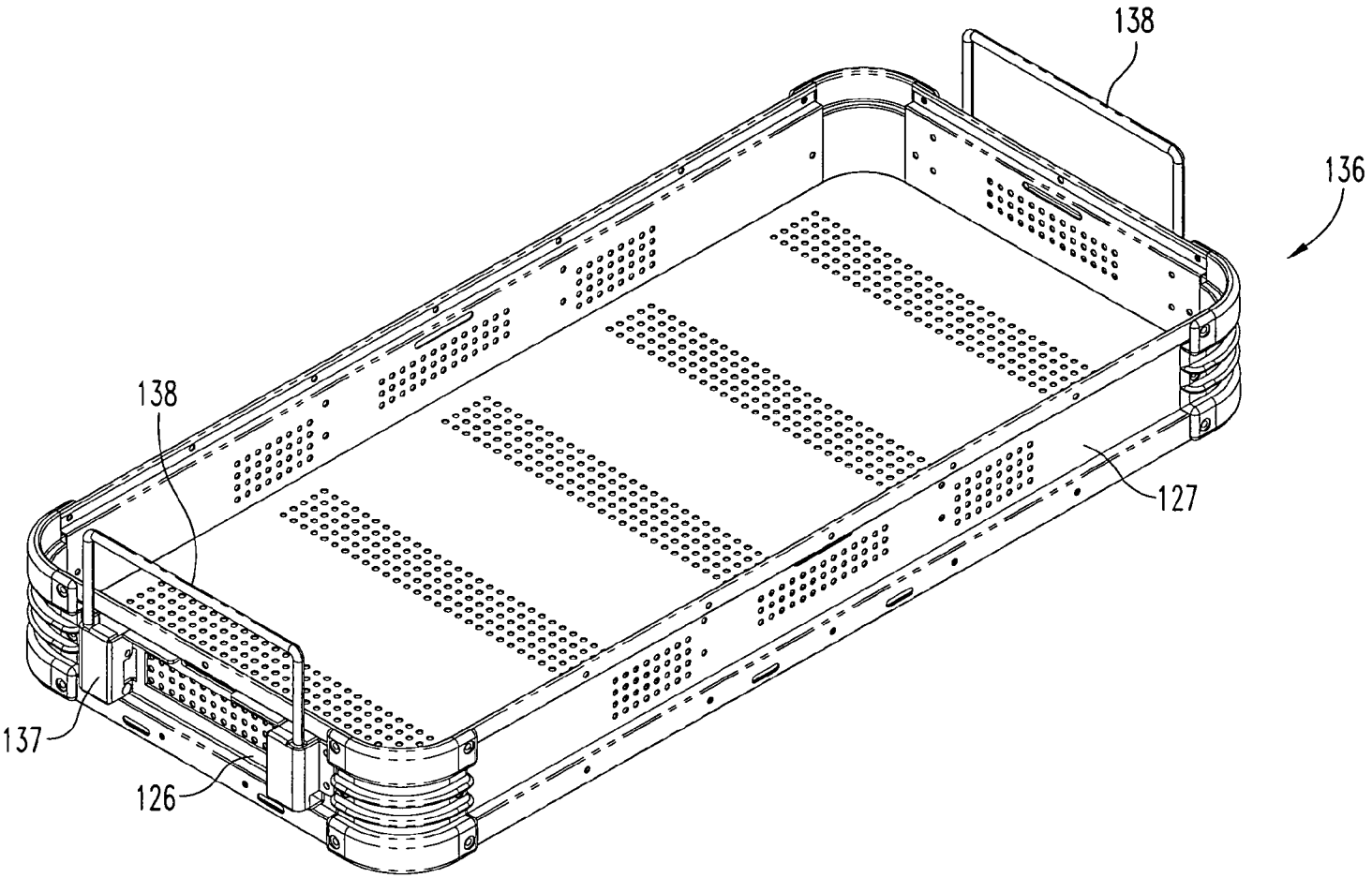
FIG. 30 is a perspective view of the FIG. 29 embodiment with the gripping member portion of the handle in an extended position.
Figure 31:
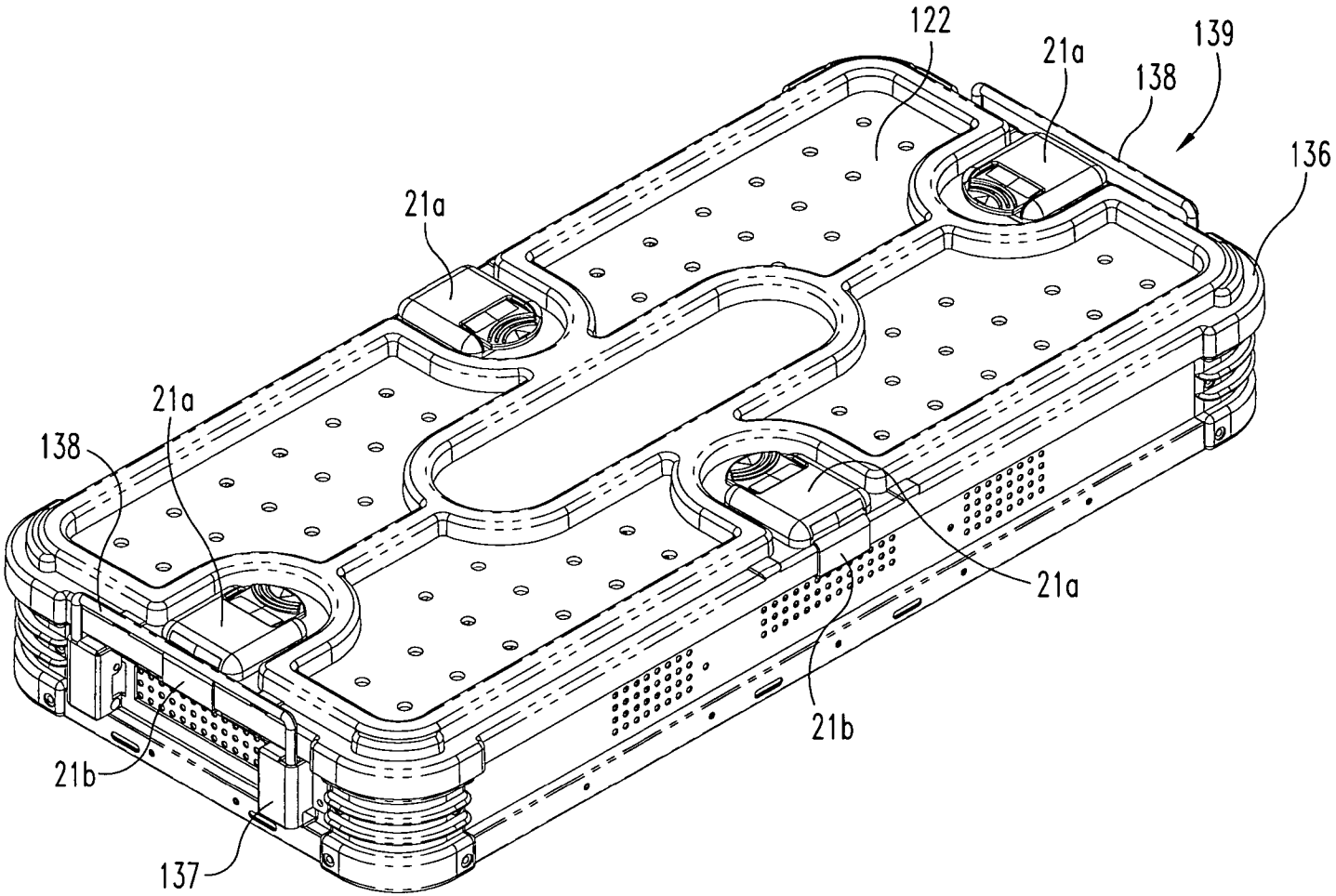
FIG. 31 is a perspective view of a completed case corresponding to the FIG. 29 embodiment with a closing lid and slide latches.

Referring now to FIGS. 29-31, another variation for a stackable tray 136 is illustrated. This tray includes only end handles 137, one at each end, attached to the corresponding end wall 126. There are no pivot latches assembled to tray 136, but the handle 137 includes some of the same component parts that are used to construct the pivot latches 123 and 124. The details of the construction of handle 137 will be described in greater detail hereinafter as part of the more detailed description of the construction of pivot latches 123 and 124.

FIG. 30 illustrates that the gripping member 138 of each handle 137 is extendable for ease of grasping when lifting and/or transporting tray 136. FIG. 31 illustrates the step and construction of adding a closing lid 122 to tray 136 and thereby converting the tray into a case 139. Lid 122 includes four slide latches 21*a* and these provide the sole means of securing the lid 122 to the tray 136 by the sliding insertion of the tongue 21*b* of each latch 21*a* into a corresponding and cooperating slot 140 in each end wall 126 and in each side wall 127.

Referring now to FIGS. 32-37, the details of end pivot latch 123 are illustrated. Generally speaking, side pivot latch 124 is the same as end pivot latch 123 without the gripping member 138. When gripping member 138 is removed, the base component part that is used in end pivot latch 123 changes slightly, both for functional reasons and for aesthetic reasons. For example, without the gripping member 138, certain concerns with regard to latch clearance, tray clearance, and lid clearance are eliminated. Further, the clearance opening 143 of latch 123 is not required and thus for aesthetic purposes that clearance opening is closed in latch 124. As noted above, handle 137 is similar to end pivot latch 123, except that the pivot plate 144 and its cooperating parts are not included as part of handle 137.

Figure 36:
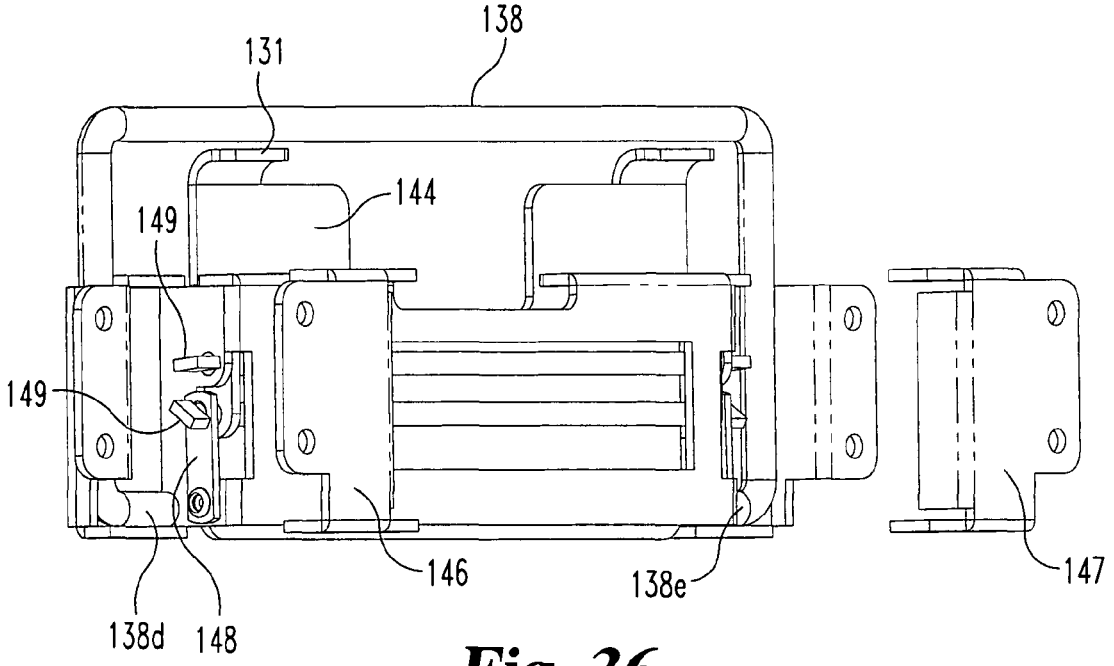
FIG. 36 is a partially exploded perspective view illustrating the back side of the FIG. 35 illustration.
Figure 37:
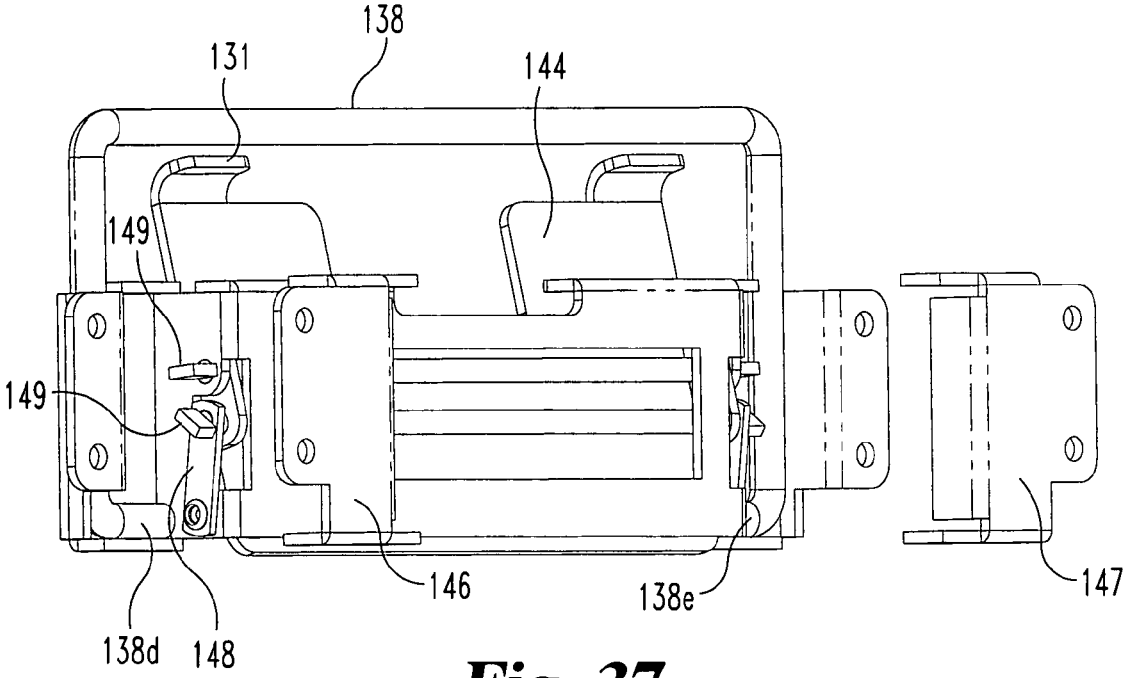
FIG. 37 is a partially exploded perspective view of the FIG. 36 embodiment with the end pivot latch in an open condition.
Figure 38:
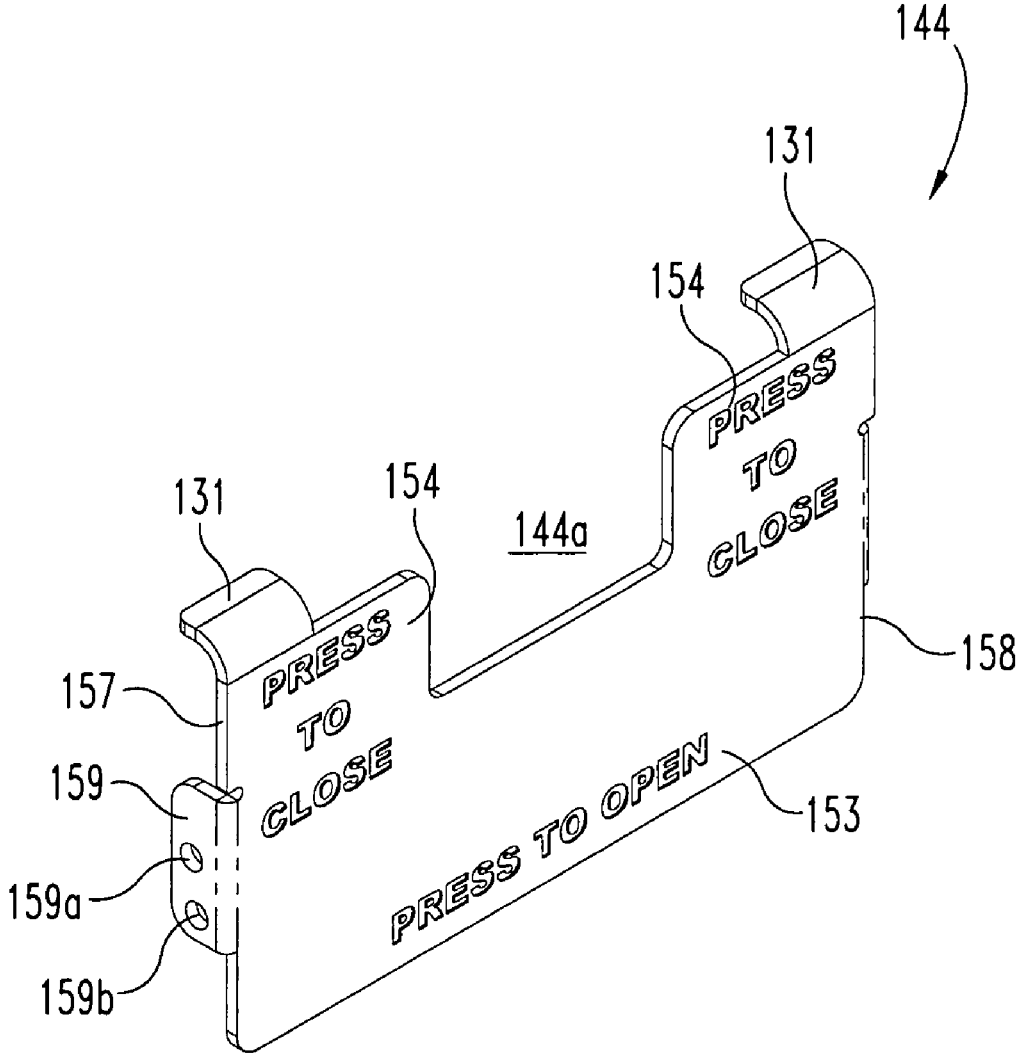
FIG. 38 is a perspective view of a pivot plate comprising one portion of the FIG. 32 end pivot latch.
Figure 39:
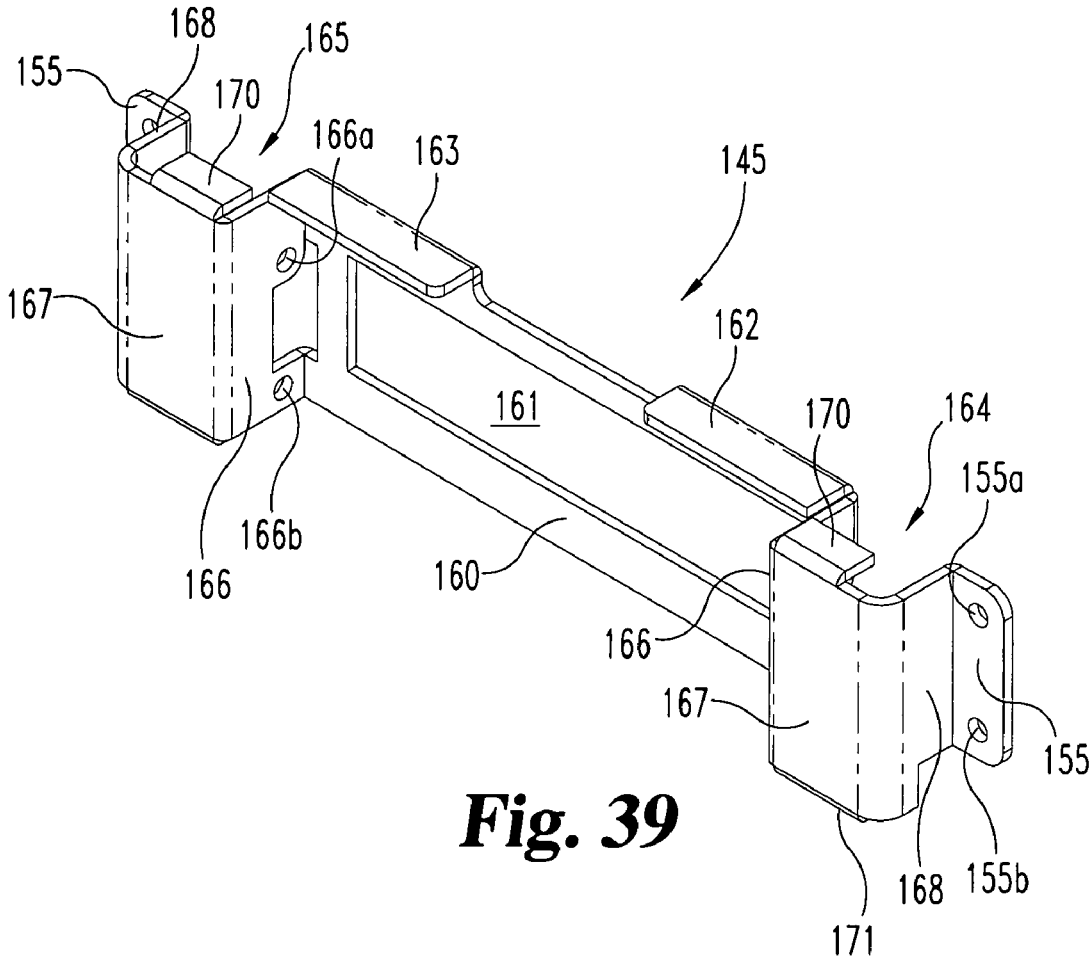
FIG. 39 is a perspective view of a base comprising one portion of the FIG. 32 end pivot latch.
Figure 40:
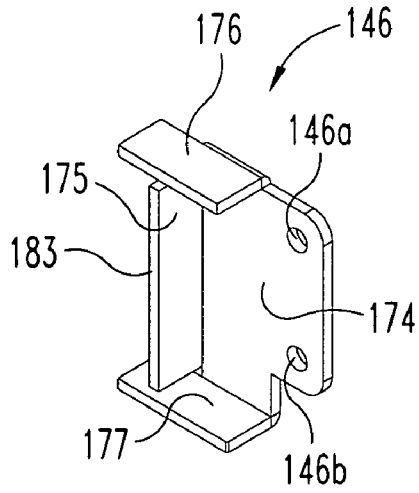
FIG. 40 is a right end member comprising one portion of the FIG. 32 end pivot latch.
Figure 41:
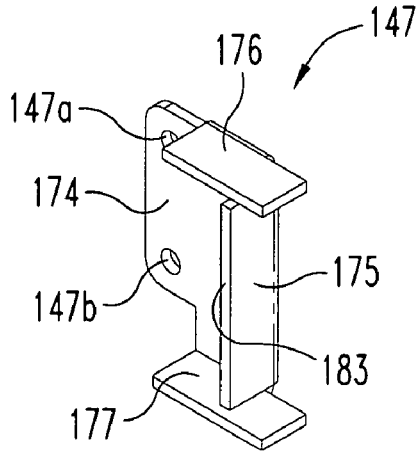
FIG. 41 is a left end member comprising one portion of the FIG. 32 end pivot latch.
Figure 42:
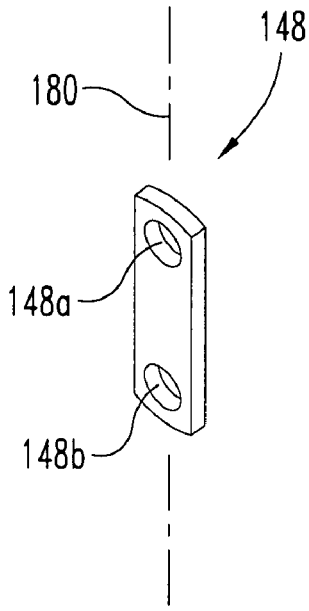
FIG. 42 is a perspective view of a link member comprising one portion of the FIG. 32 end pivot latch.
Figure 43:
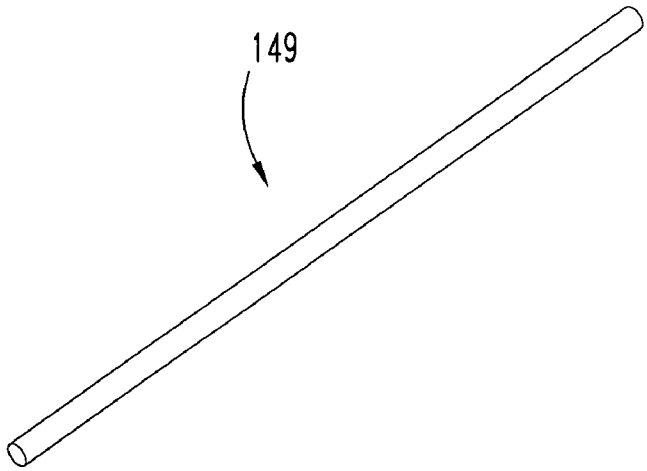
FIG. 43 is a perspective view of a rod member comprising one portion of the FIG. 32 end pivot latch.
Figure 44:
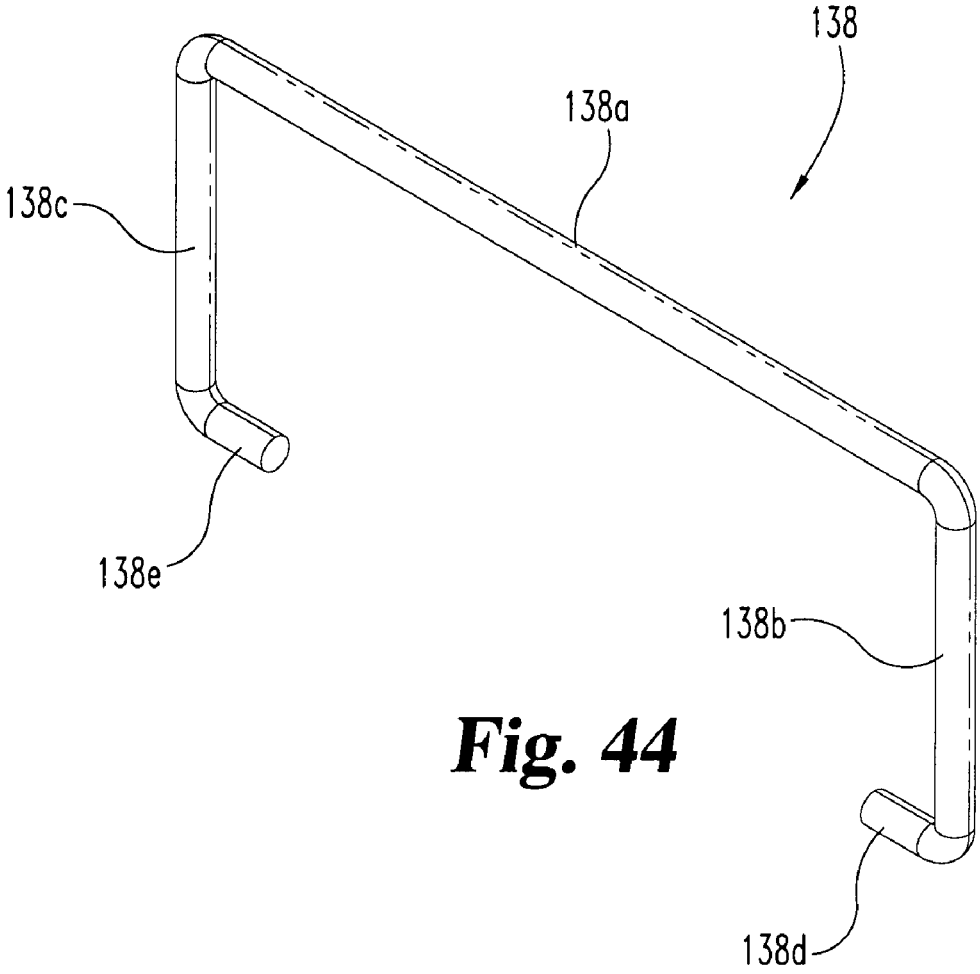
FIG. 44 is a gripping member comprising one portion of the FIG. 32 end pivot latch.

With continued reference to FIGS. 32-37, end pivot latch 123 includes the extendable gripping member 138, the pivot plate 144, a base 145, a right end member 146, a left end member 147, a pair of links 148, and a pair of pivot rods 149. The pivot plate 144 is illustrated in FIG. 38. The base 145 is illustrated in FIG. 39. The right end member 146 is illustrated in FIG. 40. The left end member 147 is illustrated in FIG. 41. A single link 148 is illustrated in FIG. 42. A single rod 149 is illustrated in FIG. 43. The gripping member 138 is illustrated in FIG. 44.

Figure 32:
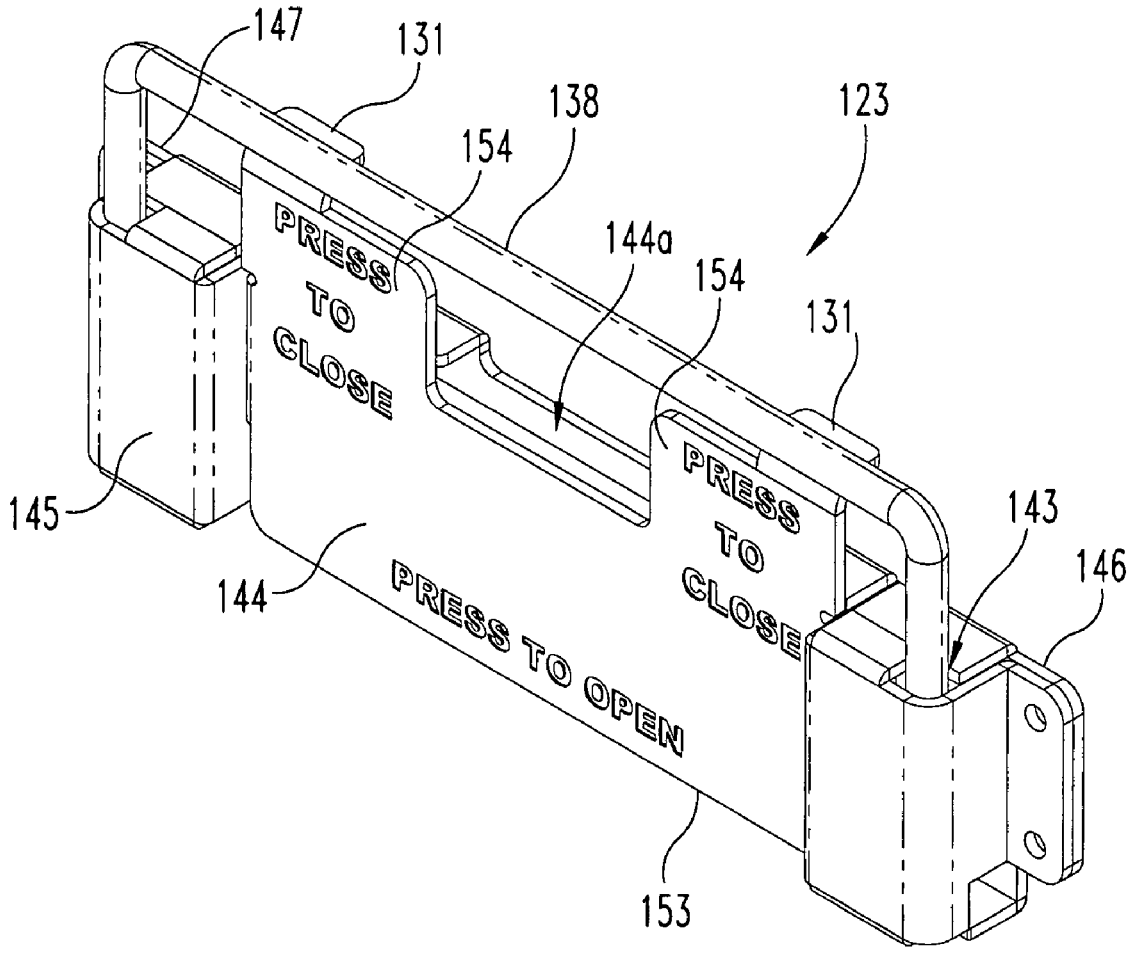
FIG. 32 is a perspective view of one end pivot latch in a closed condition.
Figure 33:
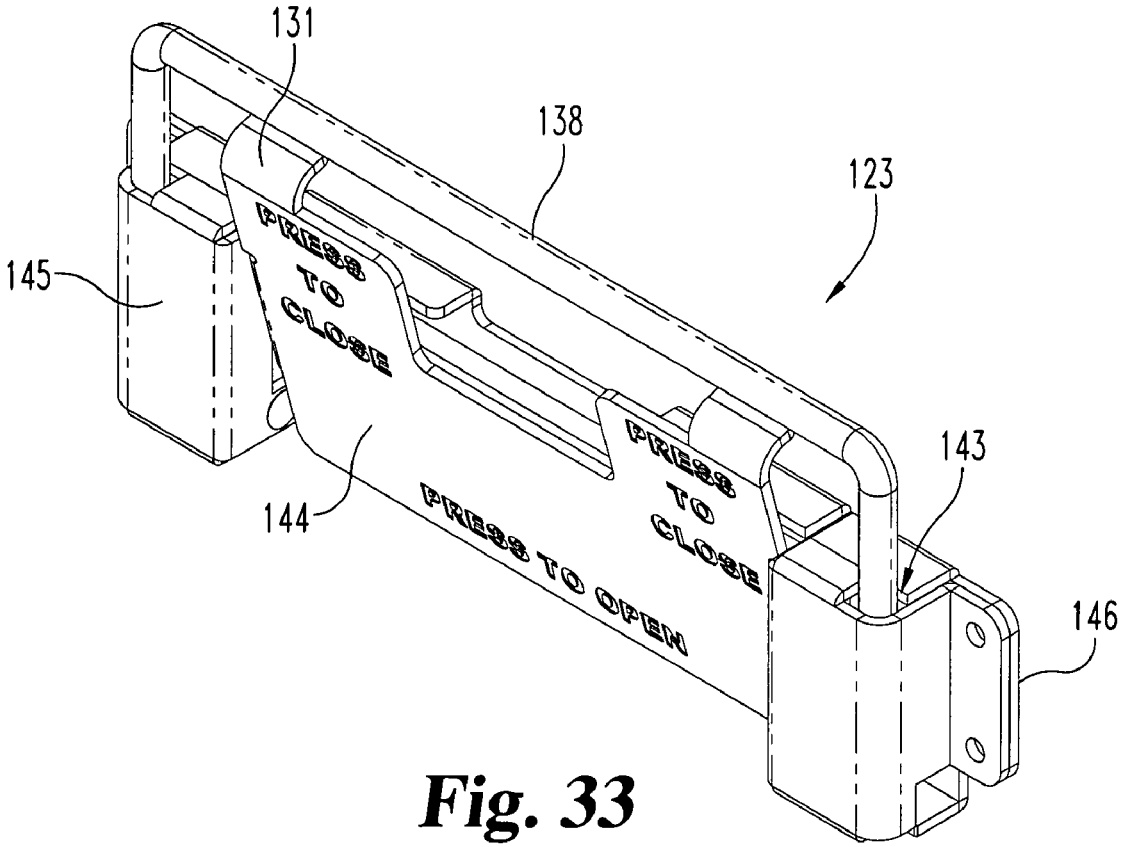
FIG. 33 is a perspective view of the FIG. 32 pivot latch in an open condition.

The assembly of end pivot latch 123 is illustrated in FIG. 32 in the closed or latched condition with the gripping member 138 nested or retracted. The open or unlatched condition of latch 123 is illustrated in FIG. 33. The pivoting of plate 144 from the closed condition to the open condition is accomplished by pushing inwardly on the lower portion 153 such that the two upper spaced-apart portions 154, including the two spaced-apart connecting tabs 131, pivot outwardly, away from the tray and lid. For a single-tray case that includes a closing lid 122, this opening (pivoting) action pulls the connecting tabs 131 off of the outer peripheral edge of lip of the lid, enabling the lid 122 to be removed. In a stacked arranged of single trays, where adjacent trays are inter-connected to one another, the opening or pivoting action pulls the connecting tabs 131 out of the corresponding and cooperating slots 132. To pivot plate 144 to a closed condition, the reverse sequence occurs. This is accomplished by pushing inwardly on either portion 154. The recessed notch 144*a* between the two "press to close" tabs 154 provides clearance for the tongue 21*b* of a corresponding slide latch 21*a*.

Figure 34:
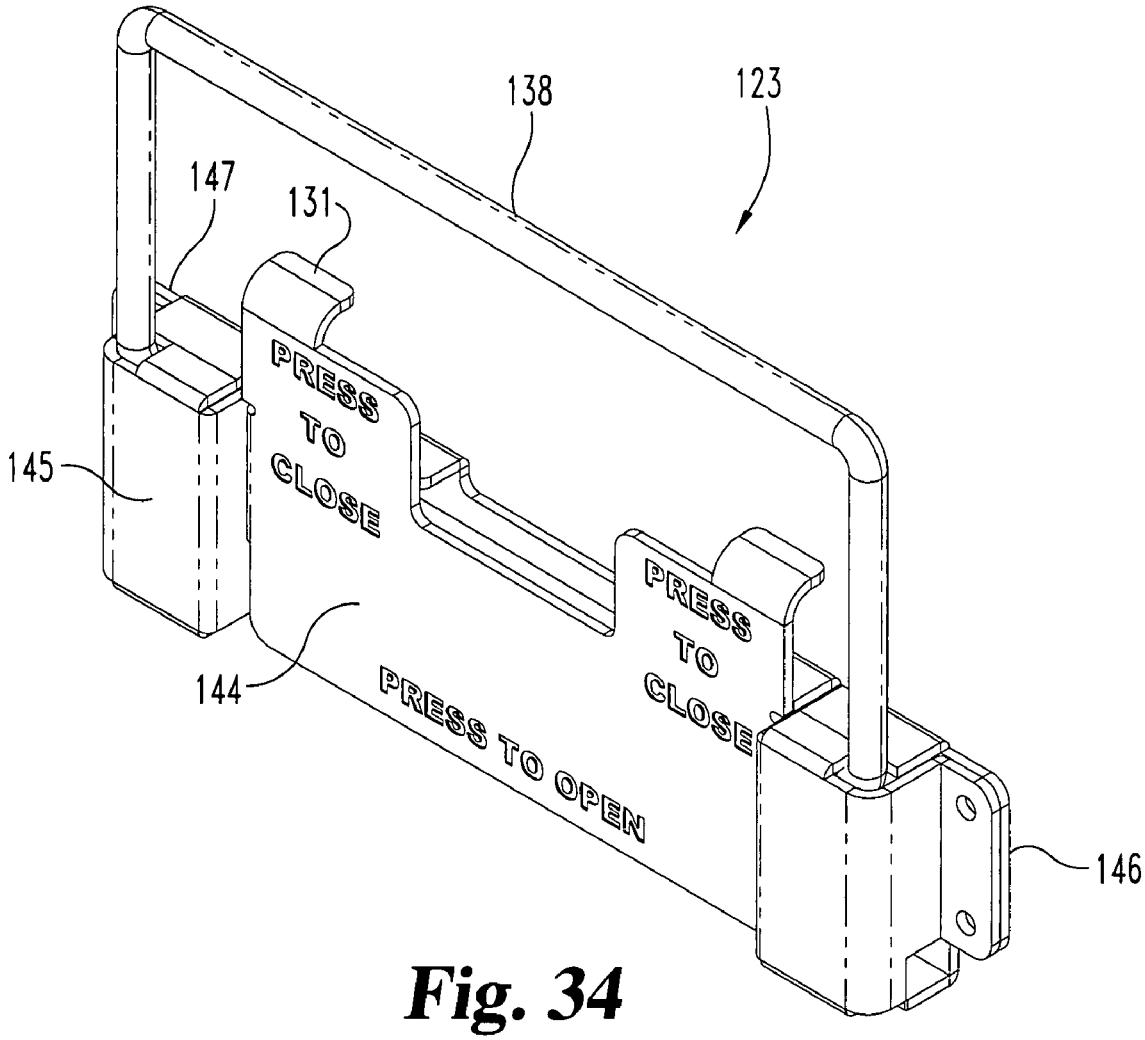
FIG. 34 is a perspective view of the FIG. 32 end pivot latch with the gripping member in an extended condition.
Figure 35:
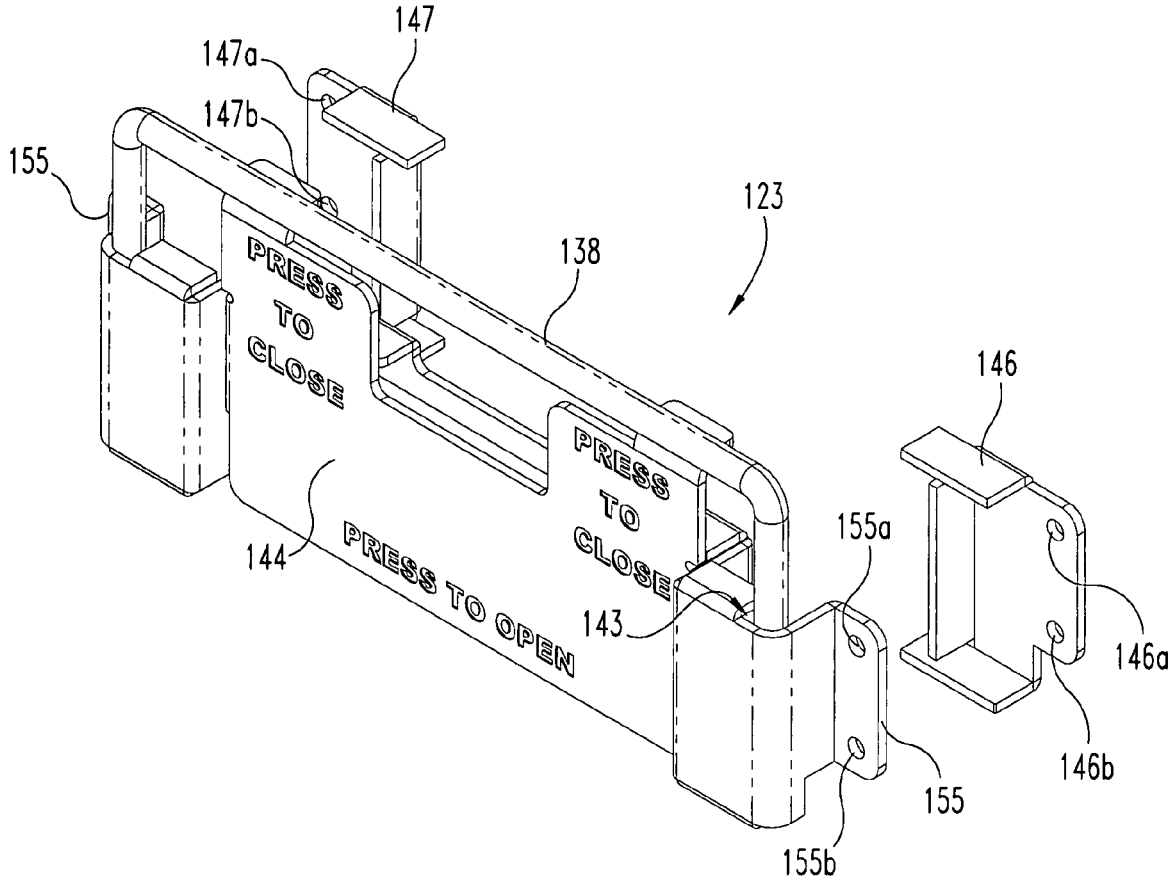
FIG. 35 is a partially exploded view of the FIG. 32 end pivot latch.

FIG. 34 illustrates a closed condition for side pivot latch 123 with the gripping member 138 upwardly extended. FIG. 35 illustrates in partial, exploded view form the FIG. 32 condition. Right end member 146 and left end member 147 are illustrated in this exploded view to show that they are not directly attached or connected to the remainder of the end pivot latch 123. Rather, the riveting of the base 145 to the end wall 126 of the tray also captures each corresponding end member 146 and 147 between the corresponding base flange 155 as the pair of clearance holes 155*a* and 155*b* of each flange align with the pair of clearance holes 146*a* and 146*b* and 147*a* and 147*b* in the corresponding end member. While the two end members 146 and 147 are considered to be a part of the end pivot latch 123, due to their function and cooperation, they are not otherwise physically attached to the remainder of the end pivot latch 123.

FIG. 36 illustrates the opposite face or back side of the exploded view (partial) of FIG. 35 with only the end members 146 and 147 exploded out, with the end pivot latch otherwise in a closed condition. FIG. 37 illustrates the same orientation as FIG. 36, except within the FIG. 37 illustration the end pivot latch is in an open condition.

Referring now to FIGS. 38-44, the component parts that comprise end pivot latch 123 are illustrated. The pivot plate 144 includes the curved connecting tabs 131 that are adjacent outer edges 157 and 158. Formed as part of outer edge 157 is pivot lip 159 defining upper hole 159*a* and lower hole 159*b*. The opposite outer edge 158 includes a similar pivot lip 159 with upper and lower holes that are axially (horizontally) aligned with holes 159*a* and 159*b* of the pivot lip 159 that is adjacent and part of outer edge 157.

The base 145 (see FIG. 39) is formed with a center section 160 with an opening 161, upper, spaced-apart tabs 162 and 163, and end pockets 164 (right side) and 165 (left side). The opening 161 is constructed and arranged so as to permit the flow of sterilant and/or steam through any openings or perforations in the end wall 126 and side wall 127. Opening 161 also reduces the overall weight of each pivot latch 123 and 124. Although, as will be described in greater detail hereinafter, the base component used for each side pivot latch 124 is configured somewhat differently from base 145, base 185 used in conjunction with side pivot latch 124 still includes a corresponding opening that still performs these two functions.

Each end pocket 164 and 165 includes an inner wall 166, outer wall 167, end wall 168, attachment flange 155, upper lip 170, and lower lip 171. The right side end pocket 164 and the left side end pocket 165 are generally symmetrical relative to a vertical centerline through base 145 and these two end pockets are arranged oppositely to each other in order to maintain this symmetry. Each inner wall 166 includes an upper hole 166*a* and a lower hole 166*b*. The upper hole 166*a* in the left side end pocket 165 is axially (horizontally) aligned with the upper hole 166*a* in the right side end pocket 164. Similarly, the lower hole 166*b* in the left side end pocket 165 is axially (horizontally) aligned with the lower hole 166*b* in the right side end pocket 164. Attachment flange 155 includes an upper hole 155*a* and a lower hole 155*b*. The two upper holes 155*a*, one in each flange, are horizontally aligned and the two lower holes 155*b* are horizontally aligned.

Considering each end pocket 164 and 165, it should be noted that inner wall 166 is substantially flat (planar) and substantially parallel with outer wall 168 which is also substantially flat (planar). Outer wall 167 is substantially flat and parallel to flange 155. The upper and lower lips 170 and 171 are substantially flat and parallel to each other and substantially perpendicular to inner wall 166, outer wall 167, and end wall 168. Additionally, center section 160 is substantially flat and parallel with each outer wall 167. Spaced-part tabs 162 and 163 are substantially flat and co-planar with upper lips 170. With regard to the end pockets 164 and 165, the corners connecting inner wall 166 with outer wall 167 and end wall 168 with outer wall 167 are radiused, as would be expected from the bending or forming of metal from a one piece member into the shape provided for base 145, as illustrated in FIG. 39.

The right end member 146 is illustrated in FIG. 40 and the left end member 147 is illustrated in FIG. 41. These two component parts are identical except for the opposite (reverse) configuration in order to provide a symmetrical appearance relative to a vertical dividing centerline of the base 145. Each end member 146 and 147 includes a substantially planar main panel 174, a substantially planar vertical flange 175, a substantially planar upper lip 176, and a substantially planar lower lip 177. Panel 174 defines an upper hole 146*a* and, in vertical alignment therewith, a lower hole 146*b*. Vertical flange 175 is substantially perpendicular to main panel 174. Lips 176 and 177 are vertically aligned with each other and are substantially parallel to each other. Lips 176 and 177 are substantially perpendicular to both main panel 174 and vertical flange 175.

The link 148 (see FIG. 42) is a relatively short, flat metal bar with an upper hole 148*a* and a longitudinally aligned lower hole 148*b*, centered on centerline 180. The rod 149 (see FIG. 43) is a straight, cylindrical member. The gripping member 138 (see FIG. 44) is shaped from a cylindrical metal rod or tube into an open, generally rectangular form with a gripping portion 138*a*, sides 138*b* and 138*c*, and coaxial pivots 138*d* and 138*e*. Portion 138*a* and pivots 138*d* and 138*e* are substantially parallel to each other and substantially perpendicular to sides 138*b* and 138*c*. The bends at each corner are rounded without any sharp edges or discontinuities.

Referring now to FIGS. 35, 36, and 37, the connection of the component parts is illustrated. As previously noted, the two end members 146 and 147 that are shown in exploded view form are not directly connected to the latch base 145, but rather are positioned between the latch base and the tray end wall 126. With holes 155*a* and 146*a* aligned with each other and aligned with rivet holes in the end wall, rivets are used to securely attach the base 145 and both end members 146 and 147 to the end wall 126.

The end pivot latch base 145 is pinned together with the pivot plate 144 and two links 148 by the use of two rods 149 and two rivets. Hole 166*a* on the left end pocket 165 and hole 159*a* of the pivot plate 144 are coaxially aligned. Hole 166*a* of the right end pocket 164 and the upper hole of pivot lip 159 of edge 158 are coaxially aligned. One rod 149 is inserted through these two pairs or sets of coaxially aligned holes. The length of rod 149 is sufficient for a portion at each end to extend beyond the outer face of each inner wall. This end portion is swaged or headed in order to re-shape and/or enlarge that portion to prevent slide out or pull out of the rod 149.

The lower hole 159*b* of each pivot lip is aligned with the upper hole 148*a* of a corresponding link 148. The other rod 149 is inserted through these two pairs or sets of coaxially aligned holes. The length of rod 149 is sufficient for a portion at each end to extend beyond the outer face of each link. This end portion is swaged or headed in order to re-shape and/or enlarge that portion to prevent slide out or pull out of the rod 149. The lower hole 148*b* of one link 148 is riveted to the lower hole 166*b* of inner wall 166 of left end pocket 165. The lower hole 148*b* of the other link 148 is riveted to the lower hole 166*b* of inner wall 166 of right end pocket 164.

The gripping member 138 is placed within base 145 with one side 138*b* positioned within the right end pocket 164 and the other side 138*c* positioned within the left end pocket 165. When the right end member 146 is positioned adjacent the right end pocket 164 at the time of riveting the two to the end wall, the right end member encloses and captures side wall 138*b*. When the left end member 147 is positioned adjacent the left end pocket 165 at the time of riveting the two to the end wall, the left end member encloses and captures side 138*c*.

The shortened lateral width of each upper lip 170 relative to the overall width of outer wall 167 provides a space for clearance opening 143. The lower lip 171 of each end pocket is closer to the full width of outer wall 167 as a lower support and abutment for each corresponding coaxial pivot 138*d* and 138*e*. The outer facing edge of the upper lip 176 of each end member 146, 147 abuts up against the inner-facing edge of each upper lip 170. The outer-facing edge of each lower lip 177 of each end member 146, 147 abuts up against the inner-facing edge of each lower lip 171. The "box" that is created by this combination captures the corresponding side and pivot of the grip member 138. The outer-facing edge 183 of the vertical flange 175 of each end member 146 and 147 abuts up against the facing surface of its corresponding coaxial pivot 138*d* and 138*e*, respectively. This abutment contact causes the movement of the gripping member 138, whether being raised (extended) or lowered (retracted) to be smooth and vertical such that its movement does not interfere with any other portions of the latch, tray, or lid. At the uppermost extent, clearance is provided so that some degree of pivoting of the gripping member 138 is permitted, making it easier to be grasped by the hand/fingers of the user.

Figure 45:
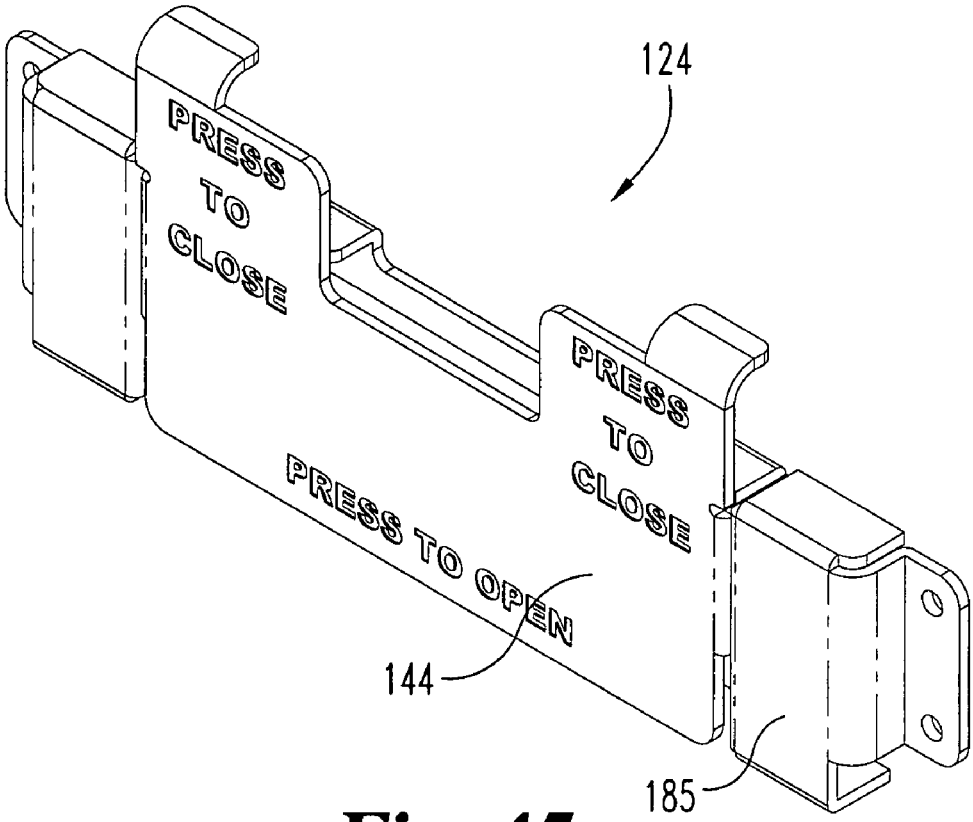
FIG. 45 is a perspective view of the side pivot latch according to the present invention.

A comparison of FIG. 32 (end pivot latch 123) and FIG. 45 (side pivot latch 124) shows that the pivot plate 144 of end pivot latch 123 is inset or recessed relative to the exposed outer surface of the two outer walls 167. This recessed configuration is achieved by the sizing and shaping of the right and left end pockets 164 and 165. By increasing the depth of each pocket, sufficient clearance space is provided for receipt of the gripping member 138. This added depth also provides a positioning for gripping member 138 that enables it to be extended and retracted without interference with any other parts of the latch and without interference with the tray and/or lid. Since a gripping member is not a part of the side pivot latches 124, the extra space and clearance are not required. This is why the side pivot latch 124 does not include a recessed or inset configuration for the pivot plate 144 relative to the remainder of the base 185.

With continued reference to FIG. 45, the details of the side pivot latch 124 are illustrated. Side pivot latch 124 includes a base 185, pivot plate 144, two links 148, and two rods 149. Effectively, the only changes from end pivot latch 123 to the side pivot latch 124 are the elimination of the two end members 146 and 147, the elimination of the gripping member 138 and the change to the base in terms of the sizing and construction of the right end pocket 164 and left end pocket 165. The change of construction from base 145 to base 185 is enabled by the elimination of the gripping member 138.

While the preferred embodiment of the invention has been illustrated and described in the drawings and foregoing description, the same is to be considered as illustrative and not restrictive in character, it being understood that all changes and modifications that come within the spirit of the invention are desired to be protected.

The invention claimed is:

1. A modular storage container for articles comprising:

a) a floor panel;

b) a plurality of side walls;

c) a plurality of end walls, wherein each of the side and end walls defines a wall end opening; and d) a plurality of corner support members constructed and arranged to be connectable adjacent one edge to a side wall and adjacent an opposite edge to an end wall, wherein each corner support member comprises a curved wall portion having a thickness extending from an inner wall surface to an outer wall surface and wherein a raised boss having a boss end surface spaced from the inner wall surface surrounds a mounting hole extending through the thickness of the wall portion from the boss end surface to communicate with the outer wall surface, each boss being constructed and arranged to fit within a corresponding wall end opening of the side wall or the end wall.

2. The modular storage container of claim 1 wherein each side wall includes an upper offset section and a lower offset section, the upper and lower offset sections of the side walls being constructed and arranged such that in a stacked configuration of a lower side wall and an upper side wall, the upper offset section of the lower side wall is aligned with the lower offset section of the upper side wall for connection.

3. The modular storage container of claim 1 wherein each end wall includes an upper offset section and a lower offset section, the upper and lower offset sections of the end walls being constructed and arranged such that in a stacked configuration of a lower end wall and an upper end wall, the upper offset section of the lower end wall is aligned with the lower offset section of the upper end wall for connection.

4. The modular storage container of claim 1 wherein each side wall is constructed and arranged with a lower offset section and each end wall is constructed and arranged with a lower offset section and wherein the floor panel includes a plurality of down-turned lips, each of which are constructed and arranged for connection to a corresponding offset section.

5. A modular storage container for articles comprising:

a) a base tray and stacked onto the base tray a second level tray frame;

b) the base tray comprising:

i) a floor panel;

ii) a plurality of side walls;

iii) a plurality of end walls, wherein each of the side and end walls of the base tray defines a wall end opening; and iv) a plurality of corner support members constructed and arranged to be connectable adjacent one edge to a side wall and adjacent an opposite edge to an end wall, wherein each corner support member of the base tray comprises a curved wall portion having a thickness extending from an inner wall surface to an outer wall surface and wherein a raised boss having a boss end surface spaced from the inner wall surface surrounds a mounting hole extending through the thickness of the wall portion from the boss end surface to communicate with the outer wall surface, each boss being constructed and arranged to fit within a corresponding wall end opening; and c) the second level tray frame comprising:

i) a plurality of side walls, wherein each side wall is constructed and arranged to be connectable to a corresponding side wall of the base tray;

ii) a plurality of end walls, wherein each end wall is constructed and arranged to be connectable to a corresponding end wall of the base tray, wherein each of the side and end walls of the second level tray frame defines a wall end opening;

iii) a plurality of corner support members constructed and arranged to be connectable adjacent one edge to a side wall and adjacent an opposite edge to an end wall, wherein each corner support member of the second level tray frame comprises a curved wall portion having a thickness extending from an inner wall surface to an outer wall surface and wherein a raised boss having a boss end surface spaced from the inner wall surface surrounds a mounting hole extending through the thickness of the wall portion from the boss end surface to communicate with the outer wall surface, each cylindrical boss being constructed and arranged to fit within a corresponding wall end opening; and iv) wherein each corner support member of the second level tray frame is constructed and arranged to be received by a corresponding corner support member of the base tray.

6. The modular storage container of claim 5 wherein each side wall includes an upper offset section and a lower offset section, the upper and lower offset sections of the side walls being constructed and arranged such that in a stacked configuration of a lower side wall and an upper side wall, the upper offset section of the lower side wall is aligned with the lower offset section of the upper side wall for connection.

7. The modular storage container of claim 5 wherein each end wall includes an upper offset section and a lower offset section, the upper and lower offset sections of the end walls being constructed and arranged such that in a stacked configuration of a lower end wall and an upper end wall, the upper offset section of the lower end wall is aligned with the lower offset section of the upper end wall for connection.

8. The modular storage container of claim 5 wherein each side wall is constructed and arranged with a lower offset section and each end wall is constructed and arranged with a lower offset section and wherein the floor panel includes a plurality of down-turned lips, each of which are constructed and arranged for connection to a corresponding offset section.

9. The modular storage container of claim 5 wherein each corner support member includes a centered tab that is constructed and arranged to fit against an upper offset portion of the corresponding corner support member.

10. The modular storage container of claim 1 wherein the boss is cylindrical.

11. The modular storage container of claim 1 wherein the outer wall surface of the curved wall portion has a recess surrounding the mounting hole opposite the boss.

12. The modular storage container of claim 11 wherein the recess is cylindrical and sized to receive the head of a fastener.

13. The modular storage container of claim 5 wherein the bosses of the corner support members for the base tray and the second level tray are cylindrical.

14. The modular storage container of claim 13 wherein the outer wall surface of the curved wall portion has a recess surrounding the mounting hole opposite the boss.

15. The modular storage container of claim 14 wherein the recess is cylindrical and sized to receive the head of a fastener.

16. The modular storage container of claim 1 wherein each corner support comprises a raised boss with a hole located adjacent to both an upper and a lower portion of the one edge and adjacent to an upper and a lower portion of the opposite edge.

17. The modular storage container of claim 16 wherein first and second axial centerlines of the respective mounting holes communicating through the thickness of the curved wall portion at the bosses located adjacent to the upper portions of the opposed edges intersect each other at a right angle and wherein third and fourth axial centerlines of the respective mounting holes communicating through the thickness of the curved wall portion at the bosses located adjacent to the lower portions of the opposed edges intersect each other at a right angle.

18. The modular storage container of claim 17 wherein the right angle intersections of the first and second axial centerlines and the third and fourth axial centerlines are located adjacent to the inner wall surface of the corner support.

19. A modular storage container for articles, which comprises:

a) a floor panel;

b) a plurality of side walls;

c) a plurality of end walls, wherein each of the side and end walls defines a wall end opening; and d) a plurality of corner support members constructed and arranged to be connectable adjacent one edge to a side wall and adjacent an opposite edge to an end wall, wherein each corner support member comprises a curved wall portion having a thickness extending from an inner wall surface to an outer wall surface and wherein a raised boss is provided with a hole, the hole extending through the thickness of the wall portion from the boss located at one of the inner and outer wall surfaces to communicate with a recess surrounding the hole at the other of the inner and outer wall surfaces opposite the boss.

20. The modular storage container of claim 19 wherein each boss is constructed and arranged to fit within a corresponding wall end opening of the side wall or the end wall.

21. The modular storage container of claim 19 wherein each recess is sized to receive a head of a fastener.

22. The modular storage container of claim 19 wherein each corner support comprises a raised boss with a hole located adjacent to both an upper and a lower portion of the one edge and adjacent to an upper and a lower portion of the opposite edge.

23. The modular storage container of claim 22 wherein first and second axial centerlines of the respective holes communicating through the thickness of the curved wall portion at the bosses located adjacent to the upper portions of the opposed edges intersect each other at a right angle and wherein third and fourth axial centerlines of the respective holes communicating through the thickness of the curved wall portion at the bosses located adjacent to the lower portions of the opposed edges intersect each other at a right angle.

24. The modular storage container of claim 23 wherein the right angle intersections of the first and second axial centerlines and the third and fourth axial centerlines are located adjacent to the inner wall surface of the corner support.

25. A modular storage container for articles comprising:

a) a floor panel;

b) a plurality of side walls;

c) a plurality of end walls, wherein each of the side and end walls defines a wall end opening; and d) a plurality of corner support members constructed and arranged to be connectable adjacent one edge to a side wall and adjacent an opposite edge to an end wall, wherein each corner support member comprises a curved wall portion having a thickness extending from an inner wall surface to an outer wall surface and wherein a raised boss having a boss end surface spaced from one of the inner and outer wall surfaces surrounds a mounting hole extending through the thickness of the wall portion from the boss end surface to communicate with the other of the inner and outer wall surfaces, each boss being constructed and arranged to fit within a corresponding wall end opening of the side wall or the end wall.

* * * * *